US007646997B2

(12) United States Patent
Hirota

(10) Patent No.: US 7,646,997 B2
(45) Date of Patent: Jan. 12, 2010

(54) TONER REPLENISHING DEVICE AND IMAGE FORMING APPARATUS HAVING THE SAME

(75) Inventor: Takashi Hirota, Yamatokoriyama (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 276 days.

(21) Appl. No.: 11/903,270

(22) Filed: Sep. 21, 2007

(65) Prior Publication Data

US 2008/0075482 A1 Mar. 27, 2008

(30) Foreign Application Priority Data

Sep. 22, 2006 (JP) ..... P2006-257938

(51) Int. Cl.
*G03G 15/06* (2006.01)

(52) U.S. Cl. ..... 399/60

(58) Field of Classification Search ..... 399/53, 399/58, 60, 27; 347/131
See application file for complete search history.

(56) References Cited

U.S. PATENT DOCUMENTS

| | | | | |
|---|---|---|---|---|
| 5,724,627 | A | 3/1998 | Okuno et al. | |
| 7,477,854 | B2 * | 1/2009 | Nakazawa et al. | 399/27 |
| 2004/0196479 | A1 * | 10/2004 | Foster et al. | 399/27 |
| 2006/0127109 | A1 | 6/2006 | Itoyama et al. | |
| 2007/0058995 | A1 | 3/2007 | Onda | |

FOREIGN PATENT DOCUMENTS

| | | |
|---|---|---|
| JP | 05-027596 | 2/1993 |
| JP | 06-175500 | 6/1994 |
| JP | 08-146736 | 6/1996 |
| JP | 2003-228229 | 8/2003 |
| JP | 2004-264765 | 9/2004 |
| JP | 2005-134664 | 5/2005 |
| JP | 3710801 | 8/2005 |
| JP | 2006-098952 | 4/2006 |
| JP | 2006-171023 | 6/2006 |

* cited by examiner

*Primary Examiner*—Susan S Lee
(74) *Attorney, Agent, or Firm*—Edwards Angell Palmer & Dodge LLP; David G. Conlin; David A. Tucker

(57) ABSTRACT

A toner replenishing device of a toner consumption calculating portion calculates a toner consumption using a gray scale value of each pixel in a multiple-value image inputted from an image data input portion. The calculated toner consumption is corrected by a corrected consumption calculating portion, and is then accumulated by a cumulative consumption calculating portion, and thereby a cumulative toner consumption is calculated. A main replenishing amount control portion controls a replenishing roller driving motor so as to replenish a predetermined first replenishing amount of a toner to a developing tank when the cumulative toner consumption reaches a reference consumption or more. Further, an auxiliary replenishing amount control portion controls the replenishing roller driving motor so as to start to replenish a predetermined second replenishing amount of a toner to the developing tank when a toner concentration obtained by a toner concentration obtaining portion reaches less than a start concentration.

8 Claims, 10 Drawing Sheets

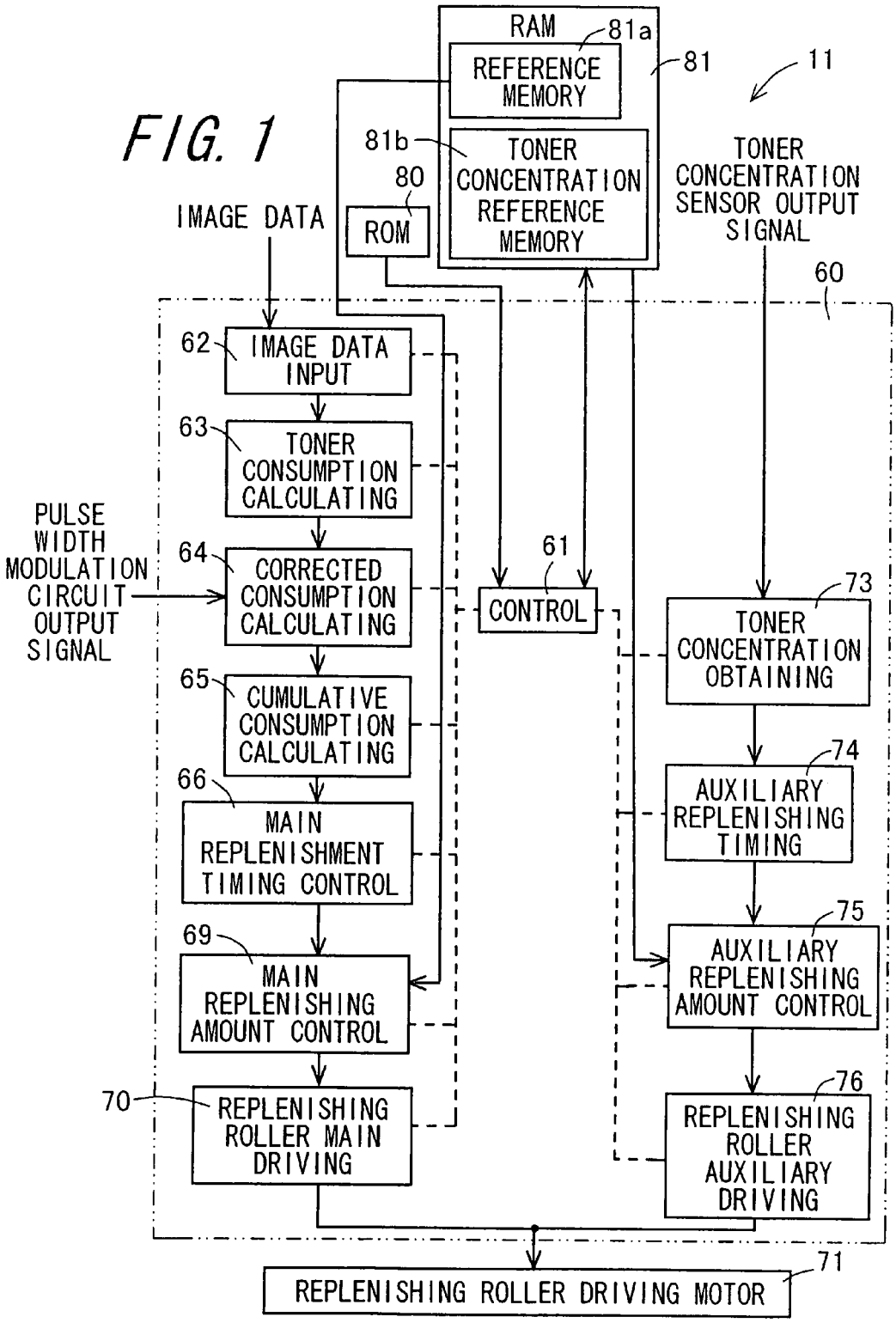
FIG. 1
RAM
81a
REFERENCE MEMORY
81
11
81b
TONER CONCENTRATION REFERENCE MEMORY
80
ROM
IMAGE DATA
TONER CONCENTRATION SENSOR OUTPUT SIGNAL
60
62
IMAGE DATA INPUT
63
TONER CONSUMPTION CALCULATING
PULSE WIDTH MODULATION CIRCUIT OUTPUT SIGNAL
64
CORRECTED CONSUMPTION CALCULATING
61
CONTROL
73
TONER CONCENTRATION OBTAINING
65
CUMULATIVE CONSUMPTION CALCULATING
74
AUXILIARY REPLENISHING TIMING
66
MAIN REPLENISHMENT TIMING CONTROL
75
AUXILIARY REPLENISHING AMOUNT CONTROL
69
MAIN REPLENISHING AMOUNT CONTROL
70
REPLENISHING ROLLER MAIN DRIVING
76
REPLENISHING ROLLER AUXILIARY DRIVING
71
REPLENISHING ROLLER DRIVING MOTOR

100

105
106
PHASE COMPARISON CIRCUIT
SMOOTHING CIRCUIT
OUTPUT
T
101
102
103
104
107
108

| | | | | | |
|---|---|---|---|---|---|
| pix1 | pix2 | pix3 | pix1 | pix2 | pix3 |
| pix4 | pix5 | pix6 | pix4 | pix5 | pix6 |
| pix7 | pix8 | pix9 | pix7 | pix8 | pix9 |

TONER REPLENISHING DEVICE AND IMAGE FORMING APPARATUS HAVING THE SAME

CROSS-REFERENCE TO RELATED APPLICATION

This application claims priority to Japanese Patent Application No. 2006-257938, which was filed on Sep. 22, 2006, the contents of which are incorporated herein by reference in its entirety.

BACKGROUND OF THE INVENTION

1. Field of the Invention

The present invention relates to a toner replenishing device for replenishing a toner to a developer storing container of a developing section for developing an electrostatic latent image using a two-component developer composed of a toner and a carrier, as well as an image forming apparatus having the same.

2. Description of the Related Art

Electrophotographic image forming apparatuses for forming an image utilizing an electrophotographic process are used, for example, as copying machines, printers, or facsimile machines. The electrophotographic image forming apparatus includes a photoreceptor drum, a charging device, an exposing device, a developing device, a transfer device, and a fixing device.

In the image forming apparatus described above, the exposing device exposes a photosensitive surface of the photoreceptor drum charged by the charging device to form an electrostatic latent image. Then, in the developing device, the formed electrostatic latent image is developed using a two-component developer composed of a toner and a carrier, and thereby a toner image as a visible image is formed. The toner image is transferred onto a recording material such as paper by the transfer device, and then the transferred image is fixed by the fixing device, and thereby an image is formed.

As described above, in the image forming apparatus for developing the electrostatic latent image using the two-component developer, a concentration of the toner contained in the two-component developer affects quality of a formed image. Therefore, the image forming apparatus described above replenishes the toner to the developer storing container, and controls so that the toner concentration falls within an appropriate range, in order to obtain an image having a constant concentration.

Techniques according to the related art with respect to replenishment of a toner to a developer storing container are disclosed in Japanese Unexamined Patent Publication JP-A 6-175500 (1994), Japanese Unexamined Patent Publication JP-A 5-27596 (1993), and Japanese Unexamined Patent Publication JP-A 2006-171023. In the image forming apparatus disclosed in JP-A 6-175500, consumption of a developer with respect to each pixel of an inputted image data is estimated based on a detection result of an edge at each pixel, and replenishment of the developer is controlled based on the estimated consumption of the developer.

Further, the image forming apparatus disclosed in JP-A 5-27596 comprises a first developer concentration control device for allowing a toner replenishing section to operate to replenish a toner according to image density information of an image information signal; and a second developer concentration control device for detecting apparent permeability (hereinafter, may be referred to as merely "permeability") of a two-component developer, and allowing the toner replenishing section to operate to replenish the toner based on the detection result. In the image forming apparatus, after a time has elapsed until the permeability of the two-component developer becomes stable, a toner replenishment control operation is switched from the operation by the first developer concentration control device to the operation by the second developer concentration control device.

Further, the image forming apparatus disclosed in JP-A 2006-171023 calculates a toner consumption based on an image data in association with development of an image corresponding to the image data, calculates corrected consumption by multiplying the calculated toner consumption by a predetermined correction factor of less than 1, carries out main replenishment for replenishing a toner based on the corrected consumption while carrying out auxiliary replenishment for replenishing the toner based on a detection result of a toner concentration sensor for detecting a toner concentration in a developer storing container.

In the technique disclosed in JP-A 6-175500, a toner is replenished only based on toner consumption calculated from an image data. The toner consumption at each pixel of the image data may be different among the pixels having a common gray scale value, thereby easily producing an error in the calculated toner consumption and accumulating the error. Therefore, a replenishing amount of the toner may be different from an amount actually required. For example, the toner may be excessively replenished. When the toner has been excessively replenished as described above, there is no alternative method but to consume the toner which has been excessively replenished by carrying out development, in order to ensure the appropriate toner concentration in a developer storing container. Therefore, it is inevitable to deteriorate quality of an image developed on a recording material.

In the technique disclosed in JP-A 5-27596, the toner is replenished by the first developer concentration control device for replenishing the toner based on the image data until the permeability of the two-component developer becomes stable. Therefore, likewise with respect to the technique disclosed in JP-A 6-175500, the toner may be excessively replenished.

In the technique disclosed in JP-A 2006-171023, the main replenishment is carried out based on the corrected consumption obtained by multiplying the calculated toner consumption by the correction factor of less than 1. However, when the replenished amount of the toner is excessively decreased, it may become possibly difficult to maintain the toner concentration in the developer storing container at a level necessary for development. In the technique disclosed in JP-A 2006-171023, there is room for improvement.

SUMMARY OF THE INVENTION

An object of the invention is to provide a toner replenishing device capable of keeping a concentration of a toner in a developer storing container constant by preventing excessive replenishment and insufficient replenishment of the toner, as well as an image forming apparatus having the same.

The invention provides a toner replenishing device for replenishing a toner to a developer storing container for storing a two-component developer composed of a toner and a carrier which is disposed in a developing section where a toner image is formed by developing an electrostatic latent image formed on an image bearing member based on a multiple-value image composed of a plurality of pixels which are each represented by a gray scale value, comprising:

(a) a replenishing section capable of replenishing predetermined first and second replenishing amounts of the toner to the developer storing container;

(b) a toner consumption calculating unit for calculating a toner consumption in association with development of an electrostatic latent image corresponding to an inputted multiple-value image, based on the inputted multiple-value image, including:

(b1) a gray scale value obtaining portion for obtaining gray scale values of pixels of the inputted multiple-value image;

(b2) an edge detecting portion for detecting an edge in the multiple-value image; and (b3) a calculating portion for obtaining an estimated value of a toner consumption from the gray scale value obtained by the gray scale value obtaining portion, and a detection result of edge by the edge detecting portion, and calculating a cumulative toner consumption from a time when the first replenishing amount of the toner has been replenished to the developer storing container, with the use of the estimated value;

(c) a concentration obtaining portion for obtaining a toner concentration of the two-component developer stored in the developer storing container; and (d) a control section for controlling the replenishing section so that when the cumulative toner consumption calculated by the toner consumption calculating unit reaches at least a predetermined reference consumption, the first replenishing amount of the toner is replenished to the developer storing container, and when the toner concentration obtained by the concentration obtaining portion falls below a predetermined start concentration, the second replenishing amount of the toner is started to be replenished to the developer storing container.

According to the invention, the toner replenishing device comprises the replenishing section, the toner consumption calculating unit, the concentration obtaining portion, and the control section. The replenishing section is capable of replenishing the predetermined first and second replenishing amounts of the toner to the developer storing container. The toner consumption calculating unit includes the gray scale value obtaining portion, the edge detection portion, and the calculating portion. The edge detecting portion detects the edge of the toner image in which the toner is consumed, in the inputted multiple-value image. The toner consumption is calculated by the calculating portion by using the detection result of the edge and the gray scale value obtained by the gray scale value obtaining portion, and the cumulative toner consumption from a time when the first replenishing amount of the toner has been replenished to the developer storing container is calculated. When the cumulative toner consumption reaches at least the reference consumption, the first replenishing amount of the toner is replenished to the developer storing container. In addition, when the toner consumption obtained by the concentration obtaining portion reaches less than the start concentration, the second replenishing amount of the toner is replenished to the developer storing container. Therefore, excessive replenishment and insufficient replenishment of the toner are prevented, and thereby the toner concentration in the developer storing container is kept constant.

Further, in the invention, it is preferable that the edge detecting portion detects a number of the pixels constituting the edge of the toner image with respect to a main scanning direction of the multiple-value image, and detects a total number of the pixels constituting the toner image; and the calculating portion calculates the estimated value of the toner consumption by using the gray scale value obtained by the gray scale value obtaining portion, and a rate of the number of the pixels constituting the edge detected by the edge detecting portion to the total number of the pixels constituting the toner image.

According to the invention, the edge detecting portion detects the number of pixels constituting the edge of the toner image with respect to the main scanning direction of the multiple-value image, and detects the total number of the pixels constituting the toner image. The estimated value of the toner consumption is obtained by the calculating portion using the rate of the number of the pixels of the edge detected as described above to the total number of the pixels of the toner image, and the gray scale value obtained by the gray scale value obtaining value. The number of the pixels constituting the edge of the toner image is detected with respect to the main scanning direction of the multiple-value image. Therefore, the number of the edge is detected in more simple configuration, compared with a case in which a number of pixels constituting the edge is detected with respect to a vertical scanning direction of the multiple-value image.

Further, in the invention, it is preferable that the calculating portion includes a small region generating portion for generating a small region composed of the plurality of pixels from the multiple-value image so that the respective pixels of the multiple-value image are included in any one of the small regions as a target pixel which is subjected to a process for conversion to a count in terms of toner amount, in order to convert respective numbers of pixels of the multiple-value image into count values having correlation with the toner consumptions; a count-in-terms-of-toner-amount calculating portion for converting the gray scale value of the target pixel within the small region generated by the small region generating portion, into a count in terms of toner amount, using the gray scale value of the target pixel and a gray scale value of at least another pixel within the small region including the target pixel, based on a previously-stored relationship between the gray scale value of the pixel within the small region and the toner consumption of the target pixel, and calculates the count in terms of toner amount of all the pixels of the multiple-value image from the respective counts in terms of toner amount of the target pixels which have been converted; and a cumulative-count-in-terms-of-toner-amount calculating portion for accumulating the count in terms of toner amount of all the pixels which has been calculated by the count-in-terms-of-toner-amount calculating portion, every time the count in terms of toner amount of the multiple-value image is calculated, to calculate the cumulative count in terms of toner amount.

According to the invention, the small region is generated from the multiple-value image by the small region generating portion. The gray scale value of the target pixel within the small region is converted into the count in terms of toner amount, using the gray scale value of the pixel and the gray scale value of another pixel within the small region including the above-described pixel. The count in terms of toner amount of all the pixels of the multiple-value image is calculated by the count-in-terms-of-toner-amount calculating portion from the obtained respective counts in terms of toner amount of the respective target pixels. The count in terms of toner amount of all the pixels is accumulated by the cumulative-count-in-terms-of-toner-amount calculating portion, and the cumulative toner consumption is calculated. As described above, the count in terms of toner amount is calculated using the gray scale value of the target pixel and the gray scale value of another pixel within the small region including the above-described pixel, and thereby the cumulative toner consumption is calculated with a high accuracy.

Further, in the invention, it is preferable that the control section controls the replenishing section so as to start to replenish the toner after a predetermined delay time has elapsed since the cumulative toner consumption has been calculated by the calculating portion.

According to the invention, the replenishing section starts to replenish the toner after the delay time has elapsed since the cumulative toner consumption has been calculated by the calculating portion. Therefore, a necessary amount of the toner is replenished to a region in which the toner concentration has been decreased by a developing process, thereby providing the uniformed toner concentration in the developer storing container.

Further, in the invention, it is preferable that the control section controls the replenishing section so as to start to replenish the toner after a predetermined delay time has elapsed since the toner consumption has been obtained by the toner concentration obtaining portion.

According to the invention, the replenishing section starts to replenish the toner after the predetermined delay time has elapsed since the toner consumption has been obtained by the toner concentration obtaining portion. Therefore, a necessary amount of the toner is replenished to a region in which the toner concentration has been decreased by a developing process, thereby providing the further uniformed toner concentration in the developer storing container.

Further, in the invention, it is preferable that the start concentration is a concentration in which a coverage of the toner to the carrier reaches 100% or less.

According to the invention, the start concentration is a concentration in which the coverage of the toner to the carrier reaches 100% or less, thereby preventing a charge failure of the toner and occurrence of fogging.

Further, in the invention, it is preferable that the control section controls the replenishing section so that when the toner concentration obtained by the concentration obtaining portion reaches less than the start concentration, replenishment of the toner to the developer storing container is started, and when the toner concentration reaches at least a stop concentration in which the toner concentration is larger than the start concentration, the replenishment of the toner to the developer storing container is stopped.

According to the invention, when the toner concentration obtained by the concentration obtaining portion reaches less than the start concentration, the replenishing section starts the replenishment of the toner to the developer storing container, and when the toner concentration reaches at least the stop concentration in which the toner concentration is larger than the start concentration, the replenishing section stops the replenishment of the toner to the developer storing container. As described above, a replenishing operation based on the toner concentration is adapted to have a hysteresis, thereby preventing a vibration called a chattering in the replenishing operation by the replenishing section.

Further, the invention provides an image forming apparatus comprising:

a latent image forming section for forming an electrostatic latent image on an image bearing member based on a multiple-value image which is composed of a plurality of pixels, and in which each pixel is represented by a gray scale value;

a developing section which includes a developer storing container for storing a two-component developer composed of a toner and a carrier, for developing the electrostatic latent image formed on the image bearing member using the two-component developer to form a toner image; and the toner replenishing device mentioned above for replenishing the toner to the developer storing container in the developing section.

According to the invention, the image forming apparatus comprises the excellent toner replenishing device described above. Accordingly, the preferable image forming apparatus is realized.

BRIEF DESCRIPTION OF THE DRAWINGS

Other and further objects, features, and advantages of the invention will be more explicit from the following detailed description taken with reference to the drawings wherein:

FIG. 1 is a block diagram illustrating a configuration of a toner replenishing device according to one embodiment of the invention;

DETAILED DESCRIPTION

Figure 2:
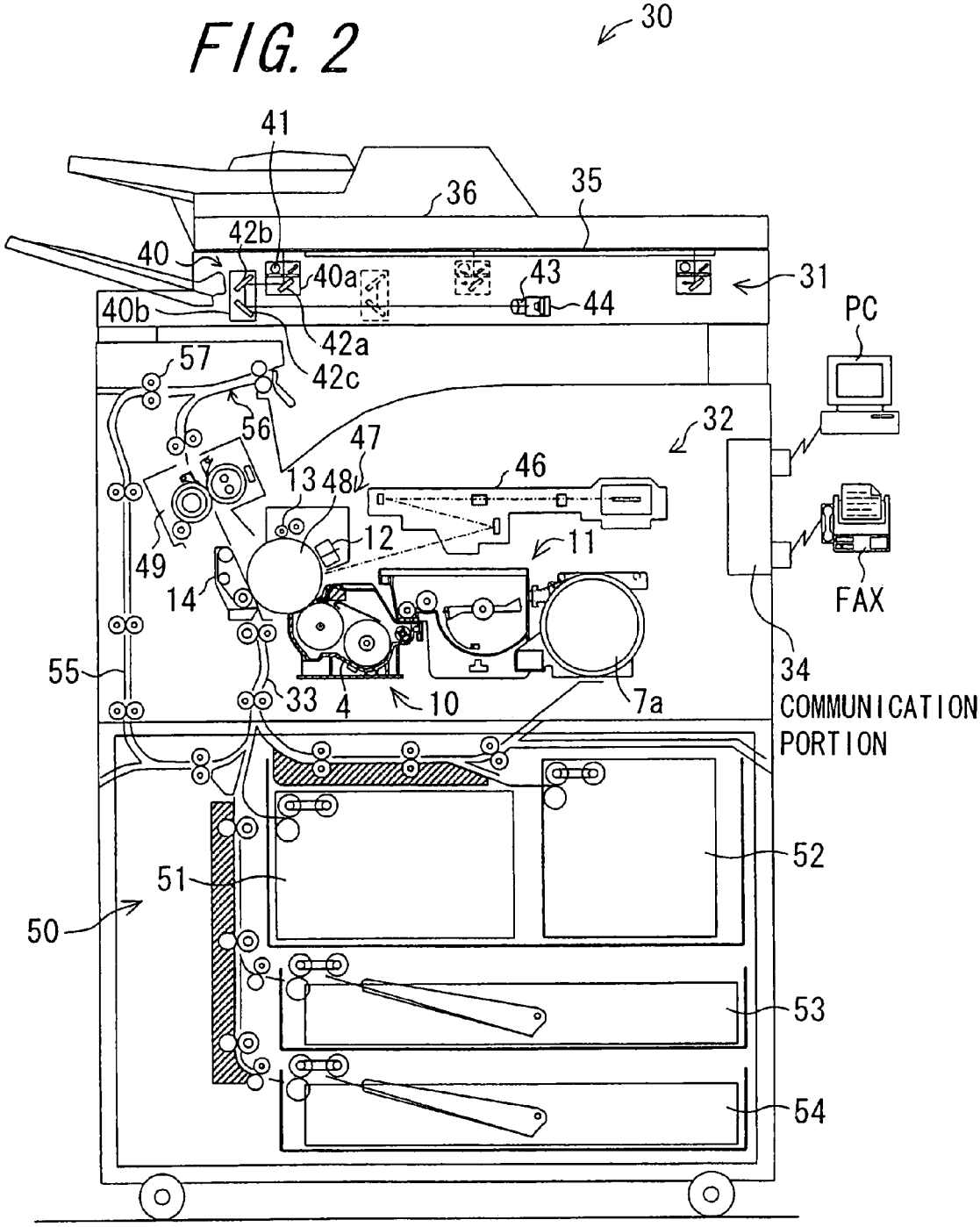
FIG. 2 is a cross-section view illustrating a schematic configuration of a copying machine as an image forming apparatus having the toner replenishing device according to another embodiment of the invention.

Hereinafter, referring to the drawings, preferred embodiments of the invention are described in detail.

FIG. 1 is a block diagram illustrating a configuration of a toner replenishing device 11 according to one embodiment of the invention. FIG. 2 is a cross-section view illustrating a schematic configuration of a copying machine 30 as an image forming apparatus having the toner replenishing device 11 according to another embodiment of the invention. The copying machine 30 includes a developing device 10 as a developing section in which a developer (a two-component developer) obtained by mixing a toner with a carrier (a magnetic carrier) is used; and a toner replenishing device 11 for replenishing the toner to a developing tank 4 as a developer storing container of the developing device 10.

(Configuration of Copying Machine 30)

The copying machine 30 has a copier function, a printer function, and a facsimile function, and includes a scanner portion 31, a communication portion 34, and a laser printer portion 32.

The scanner portion 31 includes a document setting table 35 composed of clear glass, a recirculating automatic document feeder (RADF) 36 for automatically feeding and transporting a document onto the document setting table 35, and a document image reading unit for scanning and reading an image of a document set on the document setting table 35, that is, a scanner unit 40. Moreover, the document image which has been read by the scanner portion 31 is transmitted as an image data to an image data input portion described later, and the image data is treated with a predetermined image processing.

The RADF 36 is a device for automatically feeding one by one a plurality of documents which have been collectively set on a predetermined document tray (not shown). Moreover, the RADF 36 has a function that the document is transported to a predetermined take-out position after the document image thereof has been read by the scanner unit 40.

Further, the RADF 36 has a function as the recirculating automatic document feeder. That is, the RADF 36 includes, in addition to a one-side transporting path used for reading one side, a both-side transporting path used for reading both sides, a guide for switching the transporting paths, a sensor group and a control portion for grasping (confirming) and controlling a state of a document in the respective transporting paths, and the like (all not shown). Accordingly, it is possible to reverse the document and transport it to the document setting table 35 once again after the document image thereof has been read by the scanner unit 40.

Moreover, the RADF 36 is set so as to carry out either of a one-side reading of a document or a both-side reading of a document in accordance with a selecting instruction inputted by a user (an operator).

The scanner unit 40 is a document image reading unit for reading an image of a document transported onto the document setting table 35, with respect to each line. Moreover, as shown in FIG. 2, the scanner unit 40 includes a first scanning unit 40*a*, a second scanning unit 40*b*, an optical lens 43, and a CCD image sensor 44.

The first scanning unit 40*a* is a unit for exposing a document while moving from a sheet's left side to a sheet's right side in FIG. 2 along the document setting table 35 at a constant speed V. In addition, as shown in FIG. 2, the first scanning unit 40*a* includes a lump reflector assembly 41 for irradiating with a light beam, and a first reflecting mirror 42*a* for guiding a reflected beam by a document to a second scanning unit 40*b*.

The second scanning unit 40*b* is adapted to move following the first scanning unit 40*a* at a speed of V/2, and includes a second reflecting mirror 42*b*, and a third reflecting mirror 42*c*, for guiding a light beam reflected by the first reflecting mirror 42*a* to the optical lens 43 and the CCD image sensor 44.

The optical lens 43 is a lens for condensing a light beam reflected by the third reflecting mirror 42*c* to provide an image on the CCD image sensor 44.

The CCD image sensor (a photoelectric conversion element) 44 is used for converting a light beam which has been condensed to provide an image by the optical lens 43, into an electronic signal (an electronic image signal). The analog electronic signal obtained by the CCD image sensor 44 is converted into an image data of a digital signal by a CCD board (not shown) having the CCD image sensor 44. Moreover, this image data is treated with various kinds of image processing in the image processing portion, and then stored in a memory (not shown). In addition, the image data is transmitted to the laser printer portion 32 in accordance with an output instruction from a main CPU (not shown) in the copying machine 30.

As described above, the scanner portion 31 reads a document image, by moving the scanner unit 40 along an under surface of the document setting table 35 while sequentially setting a document to be read on the document setting table 35 in association with an interlocking operation of the RADF 36 and the scanner unit 40.

The communication portion 34 carries out communication with external apparatuses such as a personal computer PC, a facsimile machine FAX, or the like, by wireless communication or wire communication. Accordingly, the communication portion 34 can send, for example, an image data read by the scanner portion 31 to an outside, or the laser printer portion 32 can form an image on a sheet (a recording material, a recording medium) based on a data received from an external apparatus.

The laser printer portion 32 is used for forming an image on a sheet based on an image data, and includes a laser writing unit 46, an electrophotographic processing portion 47, and a sheet transporting mechanism 50. The laser writing unit 46 and the electrophotographic processing portion 47 correspond to a latent image forming section.

The laser writing unit 46 irradiates a photoreceptor drum (a latent image bearing member) 48 in the electrophotographic processing portion 47 with a laser beam to form an electrostatic latent image, based on an image data read by the scanner portion 31 (the scanner unit 40), or an image data received from the external apparatuses. The laser writing unit 46 includes a pulse width modulation circuit 110 and a semiconductor laser element 111, which are described later and shown in FIG. 9, and a polygon mirror and an f-θ lens (not shown) which deflect a laser beam at the same angular speed. Here, the f-θ lens corrects a laser beam deflected by the polygon mirror so as to be deflected at the same angular speed on a surface of the photoreceptor drum 48.

An image data inputted to the laser writing unit 46 is inputted to the pulse width modulation circuit 110. The pulse width modulation circuit 110 forms and outputs, with respect to each pixel of the inputted image data, a laser driving pulse having a width corresponding to a gray scale value as a signal input value of the pixel, in more detail, having a time length. Comparatively, the pulse width modulation circuit 110 forms the driving pulse having a larger width for the signal input value corresponding to a pixel having a high gray scale value and a high concentration, forms the driving pulse having a smaller width for the signal input value corresponding to a pixel having a low gray scale value and a low concentration, and forms the driving pulse having a middle width for the signal input value corresponding to a pixel having a middle gray scale and a middle concentration.

The laser driving pulse outputted from the pulse width modulation circuit 110 is supplied to the semiconductor laser element 111. In addition, the laser driving pulse outputted from the pulse width modulation circuit 110 is inputted to an edge count portion 121 and a dot count portion 122 which are described later and shown in FIG. 9. The semiconductor laser element 111 is driven for a time period corresponding to a pulse width of the supplied laser driving pulse, to emit a laser beam. Therefore, comparatively, the semiconductor laser element 111 is driven for a longer time for a pixel having a high concentration, and is driven for a shorter time for a pixel having a low concentration.

A laser beam emitted from the semiconductor laser element 111 is swept by the polygon mirror, and is condensed to provide a spot image on the photoreceptor drum 48 by a lens such as the f-θ lens, and a fixed mirror which allows a laser beam to orient in a direction of the photoreceptor drum 48 as an image bearing member (not shown). Accordingly, the laser beam scans the photoreceptor drum 48 in a direction substantially parallel to a rotary shaft of the photoreceptor drum 48 (a main scanning direction), to form an electrostatic latent image.

The electrophotographic processing portion 47 includes the photoreceptor drum 48, a charging device 12 provided around the photoreceptor drum 48, a developing device 10, a transfer device 14, a peeling device (not shown), a cleaning device 13, and a charge removing device (not shown).

The charging device 12 uniformly charges a surface of the photoreceptor drum 48 in order to form an electrostatic latent image on the photoreceptor drum 48 by the laser writing unit 46.

The developing device 10 develops the electrostatic latent image on the photoreceptor drum 48 formed by the laser writing unit 46 to produce a toner image. The developing device 10 will be described in detail later.

The transfer device 14 electrostatically transfers the toner image produced by the developing device 10 onto a sheet (a recording medium).

The sheet transporting mechanism 50 includes, as shown in FIG. 2, a transporting portion 33, cassette paper feeding devices 51 to 54, a fixing device 49, a sheet reversing portion 55, a refeeding path 56, and a paper discharging roller 57, and has a function for feeding a sheet to the electrophotographic processing portion 47, fixing an image transferred onto the sheet, and discharging the sheet to an outside.

The transporting portion 33 transports a sheet to a predetermined transfer position (a position provided with the transfer device) in the electrophotographic processing portion 47.

The cassette paper feeding devices 51 to 54 store a sheet to be transferred, and feed the sheet into the transporting portion 33 for transferring.

The fixing device 49 fixes a toner image transferred onto a sheet. The sheet reversing portion 55 reverses front and back sides of a transported sheet and discharges the sheet, that is, switches back the sheet.

The refeeding path 56 is a path for refeeding a sheet to the transporting portion 33 in order to form an image on a back side of the sheet after the toner image is fixed.

The paper discharging roller 57 discharges a transported sheet to a post-processing device (not shown).

(Configuration of Developing Device 10)

Figure 3:
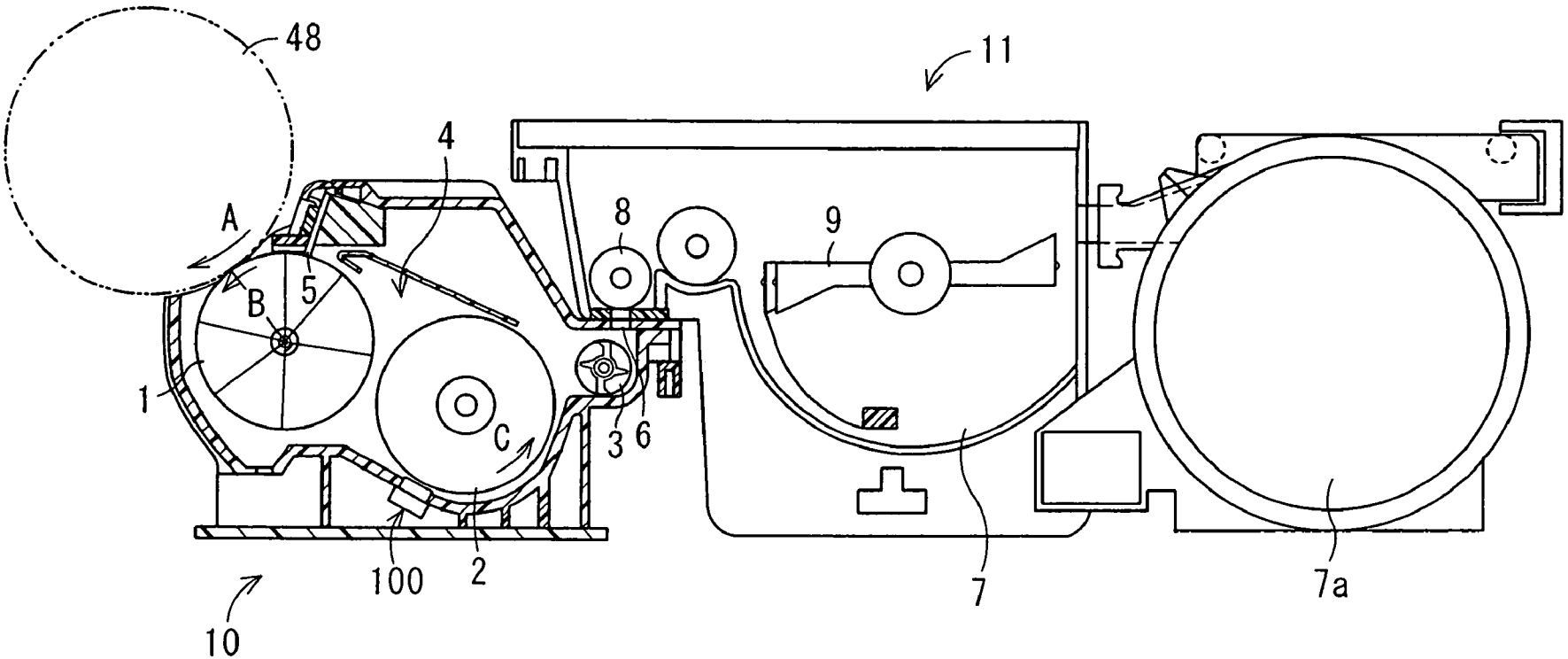
FIG. 3 is a cross-section view illustrating configurations of the toner replenishing device and the developing device.

Next, a configuration of the developing device 10 will be described. FIG. 3 is a cross-section view illustrating configurations of the toner replenishing device 11 and the developing device 10. As shown in FIG. 3, the developing device 10 as a developing section includes a developing roller 1 as a developer bearing member, agitating rollers 2 and 3, the developing tank 4 as a developer storing container, and a doctor blade 5.

The developing tank 4 is a developer storing container for storing a two-component developer composed of a toner and a carrier. The developing roller 1, the agitating rollers 2 and 3, and the doctor blade 5 are provided in the developing tank 4. Moreover, a toner concentration sensor 100 is provided at a position opposed to the agitating roller 2 in the developing tank 4. In addition, the developing tank 4 is provided with an opening 6, and a developer is supplied through the opening 6 from a toner replenishing tank 7. The toner concentration sensor 100 and the opening 6 provided with a replenishing roller 8 are provided separately in a transporting direction of the developer.

The developing roller 1 is a rotating roller having a cylindrical shape which partially exposes from an opening of the developing tank 4, and is provided so that the exposed portion is opposed to the photoreceptor drum 48. The developing roller 1 bears a toner stored in the developing tank 4, and transports the toner to an opposed portion to the photoreceptor drum 48 in the above-described exposed portion. Accordingly, the toner can be attached to the electrostatic latent image formed on the photoreceptor drum 48, and the electrostatic latent image is developed to form a toner image. Arrows A and B shown in FIG. 3 represent a rotating direction of the photoreceptor drum 48 and the developing roller 1, respectively. The developing roller 1, and the opening 6 provided with the replenishing roller 8 are provided separately in a transporting direction of the developer.

The doctor blade 5 is provided on an upstream side of a nip portion between the developing roller 1 and the photoreceptor drum 48 in the developing tank 4, defines a doctor gap Dg which is a gap between the developing roller 1 and a tip of the doctor blade 5, and removes a part of the toner attached to the developing roller 1.

Figure 4:
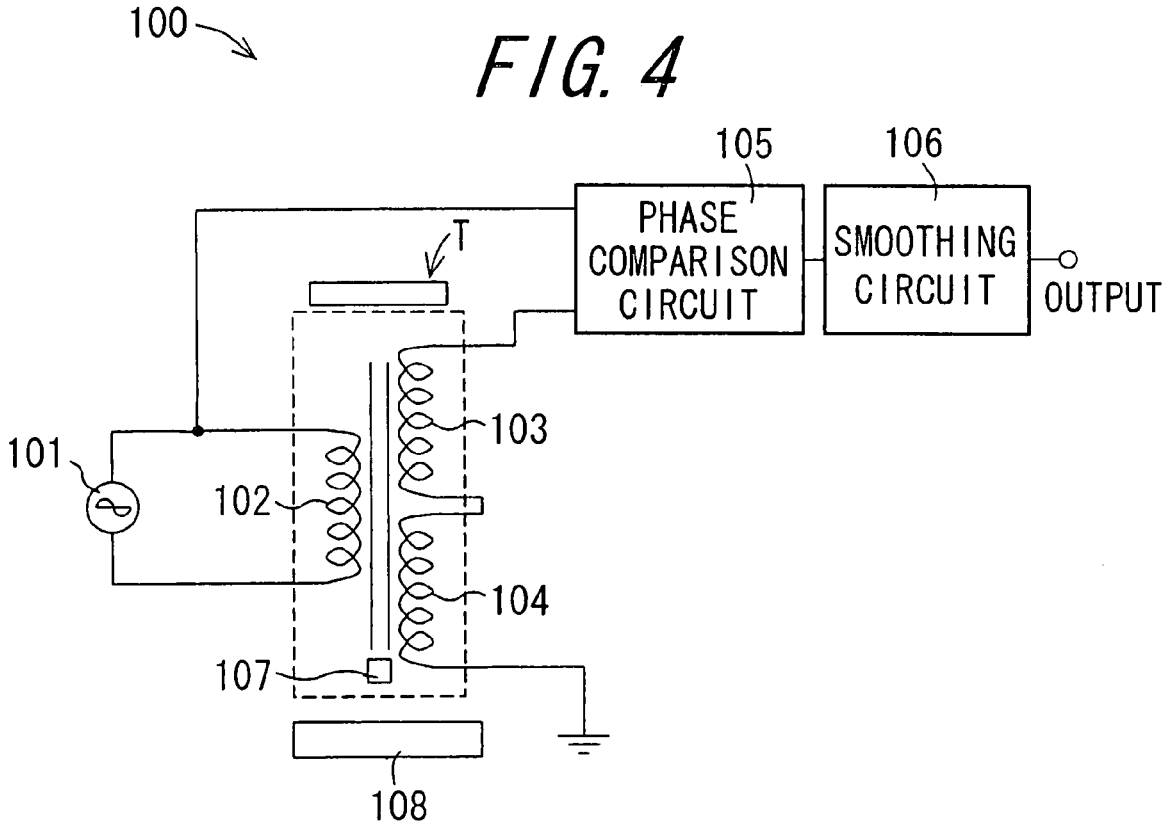
FIG. 4 is a block diagram illustrating a schematic configuration of a toner concentration sensor.

The toner concentration sensor 100 is provided at a position opposed to the agitating roller 2 in the developing tank 4, and detects a toner concentration. The toner concentration sensor is realized, for example, by a permeability sensor. FIG. 4 is a block diagram illustrating a schematic configuration of a toner concentration sensor 100. As shown in FIG. 4, the toner concentration sensor 100 includes a primary coil 102, a detecting coil 103, a reference coil 104, a phase comparison circuit 105, and a smoothing circuit 106.

Both sides of the primary coil 102 are connected to an alternating-current power supply 101. In addition, one end of the primary coil 102 is connected to the phase comparison circuit 105.

Two coils having polarities opposite to each other and a substantially same winding number are wound in series on a secondary side of the primary coil 102. One of the two coils is the reference coil 104, and the other is the detecting coil 103.

A screw core 107 having a high permeability is disposed adjacent to the primary coil 102 and the reference coil 104 so as to act as a magnetic core. An inductance between the primary coil 102 and the reference coil 104 can be adjusted by adjusting a position of the screw core 107.

The toner (the developer) to be measured flows adjacent to the primary coil 102 and the detecting coil 103 (a region T in FIG. 4, a region between the toner concentration sensor 100 and the agitating roller 2 in FIG. 3), and changes the inductance between the primary coil 102 and the reference coil 104 by action of the developer as a magnetic core. Magnitude of the inductance depends on an amount of magnetic particles of the developer or a magnetic carrier, and thereby the amount of the magnetic particles, that is, the toner concentration can be measured by an output voltage of the detecting coil 103

The reference coil 104 and the detecting coil 103 have the same winding number, and polarities opposite to each other. In addition, the reference coil 104 and the detecting coil 103 are connected in series, and thereby a difference in potential between both coils can be taken as its output. In the phase comparison circuit 105, an exclusive OR operation of an alternating voltage supplied to the primary coil 102 and the outputs from the reference coil 104 and the detecting coil 103 as a secondary coil is carried out. The output signal is then smoothed by the smoothing circuit 106, and is taken out as a direct-current voltage. Moreover, as will be described in detail later, in the developing device 10, the output voltage is used to control a replenishing amount of the toner (the developer).

The agitating rollers 2 and 3 slightly charge the developer by agitating the developer in the developing tank 4. An arrow C of FIG. 3 represents a rotating direction of the agitating roller 2.

(Configuration of Toner Replenishing Device 11)

The toner replenishing device 11 includes the toner replenishing tank 7. An opening is provided in the toner replenishing tank 7, as shown in FIG. 3, and the toner in the toner replenishing tank 7 is supplied to the developing tank 4 through this opening and the opening 6 provided in the developing tank 4. In more detail, the replenishing roller 8 as a replenishing section is provided around the opening of the toner replenishing tank 7, and a toner concentration control system 60 described later controls a rotation of a replenishing roller driving motor 71 for rotationally driving the replenishing roller 8 to control an amount of the toner to be replenished to the developing tank 4. An opening other than the above-described opening is further provided in the toner replenishing tank 7, and the toner is replenished through the opening as appropriate from a toner cartridge 7*a* which can be mounted on the toner replenishing tank 7 in an exchangeable manner. In addition, an agitating member 9 for agitating the toner (the developer) is provided in the toner replenishing tank 7.

Further, the toner replenishing device 11 includes, as shown in FIG. 1, the toner concentration control system 60, a ROM (read only memory) 80, a RAM (random access memory) 81, and the replenishing roller driving motor 71. The ROM 80, the RAM 81, the replenishing roller driving motor 71 are connected to the toner concentration control system 60. The toner concentration control system 60 includes a control section 61, an image data input portion 62, a toner consumption calculating portion 63, a corrected consumption calculating portion 64, a cumulative consumption calculating portion 65, a main replenishing timing control portion 66, a main replenishing amount control portion 69, a replenishing roller main driving portion 70, a toner concentration obtaining portion 73, an auxiliary replenishing timing control portion 74, an auxiliary replenishing amount control portion 75, and a replenishing roller auxiliary driving portion 76. The toner consumption calculating portion 63, the corrected consumption calculating portion 64, and the cumulative consumption calculating portion 65 correspond to a toner consumption calculating unit.

The control section 61 is a nerve center of the toner concentration control system 60, and controls all operations of the toner concentration control system 60. The control section 61 is realized by a central processing unit (abbreviated as a CPU). In addition, the ROM 80 stores a program such as a toner concentration control, and the control section 61 reads in the program stored in the ROM 80 and executes the program to thereby control an operation of the respective portions in the toner concentration control system 60. The control section 61 may be a part of a main CPU of the copying machine 30.

The RAM 81 includes a reference value memory portion 81*a*, and a toner concentration reference value memory portion 81*b*. The reference value memory portion 81*a* stores a reference consumption for determining whether the toner is replenished or not based on a cumulative toner consumption calculated from an image data. The toner concentration reference value memory portion 81*b* stores a start concentration which is a concentration in which the toner is started to be replenished.

The start concentration is selected to a concentration in which a coverage of the toner to the carrier is 100% or less. The "coverage of the toner" is a coverage which is obtained assuming that one toner is shared by two carriers.

In the embodiment, as described in Japanese Examined Patent Publication JP-B2 3710801, when an average volume diameter of the magnetic carrier as the carrier is represented as Dcav_vol (μm), an average volume diameter of the toner is represented as Dtav_vol (μm), a magnetic carrier specific gravity is represented as γc, and a toner specific gravity is represented as γt, the start concentration is selected to replenish the toner so that the toner concentration TD (%) obtained by the toner concentration obtaining portion 73 falls within a range specified by the following expression:

$$TD \leqq \{\gamma t \cdot Vt/Nt/(\gamma c \cdot Vc)\} \times 100$$

where, $$Vt(\text{Toner Volume}) = (\pi/6) \cdot (Dtav_\text{vol})^3$$

$$Sc(\text{Magnetic Carrier Surface Area}) = \pi \cdot (Dcav_\text{vol} + Dtav_\text{vol})^2$$

$$Nt(\text{Line Density Number}) = Sc/[(3^{0.5}/2) \cdot (Dtav_\text{vol})^2]/2$$

$$Vc(\text{Magnetic Carrier Volume}) = (\pi/6) \cdot (Dcav_\text{vol})^3 \quad (1)$$

When a specified range to which the toner concentration TD (%) obtained should be kept is set based on the expression (1) using the average volume diameter of the magnetic carrier Dcav_vol (μm), and the average volume diameter of the toner Dtav_vol (μm), the objective specified range can be precisely set, and thereby the toner concentration can be consistently controlled in an appropriate manner. Accordingly, a thin spot and fogging of an image are prevented.

Next, it will be described why the foregoing objective specified range of the toner concentration is precise. First, assume that a magnetic carrier c has a large spherical shape, and a toner t has a small spherical shape. In addition, when a number of the toners t are attached to a surface of the magnetic carrier c to thereby perfectly cover the surface of the magnetic carrier c with no more space to be attached by the toner on the surface of the magnetic carrier c, and there is no excessive toner which is not attached to the surface of the magnetic carrier c, and the one toner is shared by the two adjacent magnetic carriers, assume that the coverage of the toner is 100%, and an appropriate upper limit TD100% of the toner concentration is set at that time.

Under this condition, when an average volume diameter of the magnetic carrier is represented as Dcav_vol (μm), an average volume diameter of the toner is represented as Dtav_vol (μm), a magnetic carrier specific gravity is represented as γc, and a toner specific gravity is represented as γt, theoretically, the appropriate upper limit TD100% of the toner concentration can be calculated based on the following expression (2):

$$TD100\% = \{\gamma t \cdot Vt/Nt/(\gamma c \cdot Vc)\} \times 100 \quad (2)$$

A right term of the above-described expression (1) equals to a right term of the above-described expression (2). Therefore, the above-described expression (1) suggests that the toner concentration TD (%) is constantly brought close to the upper limit TD100% while keeping the obtained toner concentration TD (%) no more than the appropriate upper limit TD100% of the toner concentration.

When the excessive toner t remains, the obtained toner concentration TD (%) becomes out of the specified range of the above-described expression (1). In this case, the excessive toner t is supplied from the developing roller 1 as a magnet roller to the photoreceptor drum 48 to cause fogging of an image.

Therefore, the start concentration is selected to be the TD100% or less represented by the expression (2), resulting in that the coverage of the toner can be 100% or less. Accordingly, a charge failure of the toner and occurrence of fogging can be prevented.

A reference value stored in the reference value memory portion 81*a*, and a reference value of the toner concentration stored in the toner concentration reference value memory portion 81*b* may be stored, for example, in the ROM 80 in advance, or may be set by a user through an input section (not shown).

Further, the control section 61 may temporarily store in the RAM 81 information such as a program read from the ROM 80, or information of the toner concentration based on an output voltage of the toner concentration sensor 100.

An image data in which an image read by the scanner portion 31, or an image data received from an external device through the communication portion 34 are treated with a predetermined image processing is inputted to the image data input portion 62. Examples of the predetermined image processing include a pre-processing for the following image processing; an input gamma correcting, converting, and region separating processing in an image adjustment; a region determining processing for a character region and a dot photograph region; a region separating processing for adding an identifying signal indicating a region determining result with respect to each region; a color correcting processing for converting a RGB image signal into a CMYK (yellow, magenta, cyan, and black) image signal; a variable power processing; a space filter processing; and a halftone gamma property correcting processing. In addition, the image data input portion 62 outputs the inputted image data to the toner consumption calculating portion 63.

The toner consumption calculating portion 63 carries out a pixel count while multiplying an image signal of a multiple-value image as an image data inputted from the image data input portion 62 by a weighting coefficient in increments of a pixel, to calculate the toner consumption. The multiple-value image is composed of a plurality of pixels, and each pixel is represented by a gray scale value.

Here, a calculating processing of the toner consumption will be described in more detail. Note that the following processing is carried out with respect to each color (with respect to each CMYK signal to be inputted, for example), when a color image is formed.

Figure 5:
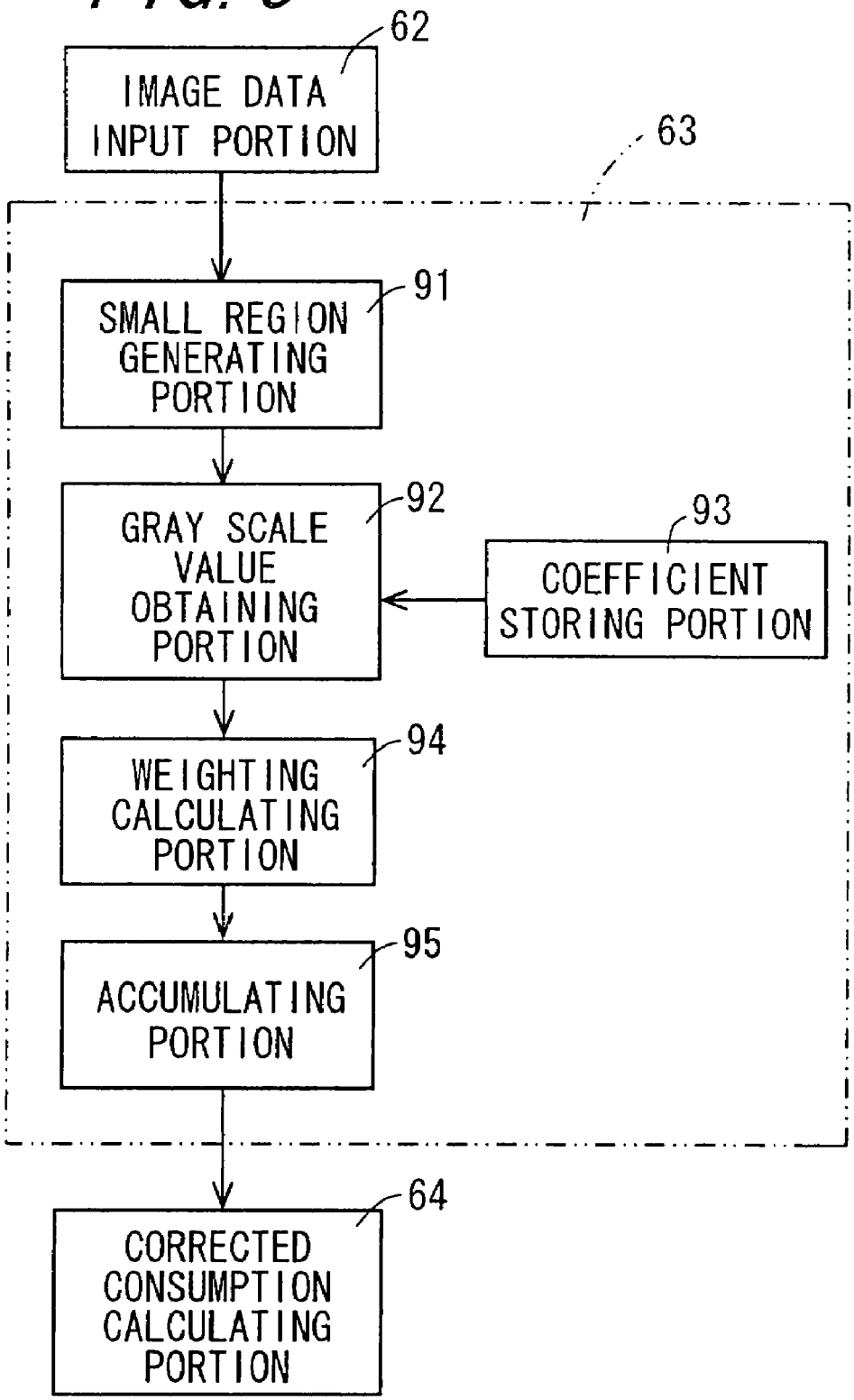
FIG. 5 is a block diagram illustrating a configuration of a toner consumption calculating portion.

FIG. 5 is a block diagram illustrating a configuration of a toner consumption calculating portion 63. In FIG. 5, the image data input portion 62 and the corrected consumption calculating portion 64 are collectively shown. The toner consumption calculating portion 63 includes a small region generating portion 91, a gray scale value obtaining portion 92, a coefficient storing portion 93, a weighting calculating portion 94, an accumulating portion 95. The weighting calculating portion 94 and the accumulating portion 95 correspond to a calculating portion, in more detail, a count-in-terms-of-toner-amount calculating portion.

The small region generating portion 91 groups output image signals of the respective images outputted from the image data input portion 62 into a signal with respect to each predetermined small region. The signal input value of each pixel included in each small region contributes to a count value having correlation with the toner consumption with respect to the small region (hereinafter, may be referred to as a "count in terms of toner amount").

In the copying machine 30, an electrostatic latent image formed on the photoreceptor 48 changes in its developing property depending on the signal input values of the surrounding pixels even though some pixels have the same signal input values (gray scale values). When the laser writing unit 46 irradiates a certain pixel with a light beam under the fixed exposing condition corresponding to the gray scale data of the pixel, the electrostatic latent image has different quality depending on the exposing condition of the surrounding pixels. Therefore, an amount of the toner attached to the electrostatic latent image is also different. Therefore, the toner consumption at each pixel is affected by the signal input values of the surrounding pixels. Consequently, in the embodiment, the count in terms of toner amount corresponding to an estimated value of the toner consumption at each pixel is calculated by using the weighting coefficient corresponding to the signal input values of a plurality of pixels included in a small region, instead of considering only the signal input value of each pixel.

The small region generating portion 91 generates a pixel group which is represented, for example, as a matrix of 3 by 3 or 4 by 4 for all pixels constituting a whole image, when grouping the signals with respect to each small region. It is only necessary for the small region composed of the above-described pixel group to have one continuous region having any shape. At this time, each of all the pixels is defined as a pixel of interest, and the small region may be created one by one with respect to each pixel of interest, or all the pixels may be divided so that each pixel is included only in any one small region to create the small region. In both cases, the small region generating portion 91 generates the small region composed of the plurality of pixels for the inputted image signals so that each pixel is included in any one small region as a target pixel which is subjected to a process for conversion to a count in terms of toner amount.

Figures 6, 7:
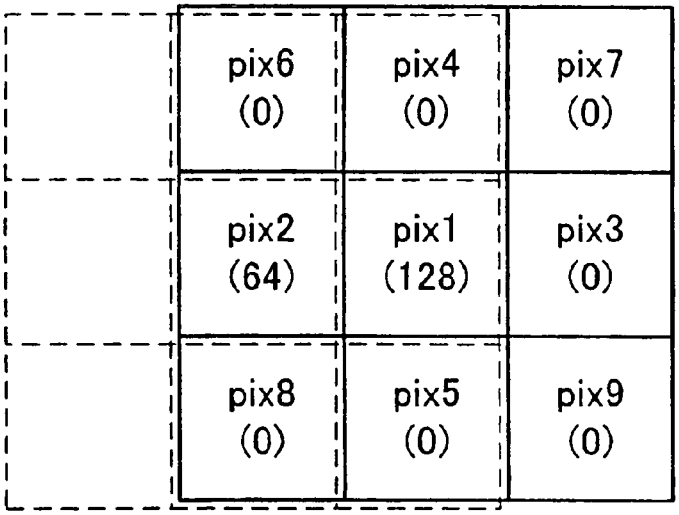
FIG. 6 is a view illustrating a first generation example of a small region.
FIG. 7 is a view illustrating a second generation example of a small region.

FIG. 6 shows an example of a small region represented as a matrix of 3 by 3 in which each pixel is a pixel of interest in any one small region. The pixel of interest is the target pixel. In this small region (shown with a solid line), a pixel pix1 in a center is the pixel of interest. When the input signal value is represented by 256 gray scales, for example, a case is shown in which the signal input value of the pixel pix1 is 128, and the signal input value of a pixel pix2 on an immediate left side thereof is 64, and the signal input values of the other pixels are 0. When the pixel pix2 is the pixel of interest, another small region shown with a broken line is generated. Therefore, both small regions are overlapped each other, and the signal input value of each pixel is used more than once for calculation in another small region. In a small region in which the pixel of interest is positioned at an edge of an image, a dummy value may be set as the signal input value of a pixel out of an image region.

Further, FIG. 7 shows an example of a small region represented as a matrix of 3 by 3 in which each pixel is included only in any one small region. In this case, the small regions correspond to regions obtained by dividing the whole image, and are not overlapped each other. Therefore, all the pixels of the small regions are the target pixels which are each subjected to a process for conversion to a count in terms of toner amount.

The small region described above preferably has a region which is not too large in order to appropriately reflect an effect of the surrounding pixels, and is adapted to have a matrix of 6 by 6 at a maximum. The small region can have any shape, and the small region which can be included in a matrix of 6 by 6 is preferable. When the small region which is too large is generated, accuracy of the following count-in-terms-of-toner-amount calculation is decreased.

The respective signal input values are inputted to the gray scale value obtaining portion 92 in combination with grouping information to the small region after being grouped to the respective regions in the small region generating portion 91. By using the grouping information to the small region, it is not necessary to create the two or more signal input values of the same pixel even when a pixel used for two or more small regions exists, as shown in FIG. 6.

The gray scale value obtaining portion 92 obtains the gray scale value with respect to each pixel of the inputted multiple-value image. Hereinafter, obtaining of the gray scale value may be referred to as a "count". The "multiple-value image" means, for example, an image having multiple gray scales such as 16 gray scales, and 256 gray scales. In the embodiment, the gray scale value obtaining portion 92 obtains the gray scale value with respect to each pixel for the respective small regions of the inputted multiple-value image. That is, the gray scale value obtaining portion 92 counts the gray scale value as the signal input value with respect to each pixel constituting the multiple-value image, for example, the signal input value representing 0 to 255 in a case of 256 gray scales in which the signal input value takes a value of 0 to 255, with respect to each small region.

The coefficient storing portion 93 stores the weighting coefficient corresponding to the gray scale value with respect to each pixel of the inputted multiple-value image, in more detail, a weighting coefficient table including the weighting coefficients corresponding to the respective gray scales.

The weighting calculating portion 94 first carries out a correcting calculation of the count values of the respective target pixels of the respective small regions, which have been counted by the gray scale value obtaining portion 92, in order to obtain values based on an effect of the surrounding pixels, and further carries out weighting of the corrected values in order to calculate the count in terms of toner amount. To carry out the weighting, the weighting calculating portion 94 obtains the weighting coefficient suitable for the small region including the respective pixels from the weighting coefficient table stored in the coefficient storing portion 93, and multiplies signal values obtained by carrying out the correcting calculation of the input signal values in the small regions by the obtained weighting coefficient. In the weighting coefficient table stored in the coefficient storing portion 93, the respective weighting coefficients representing the counts in terms of toner amount corresponding to the plurality of input signal values are included. As described above, in the toner consumption calculating portion 63, the count in terms of toner amount corresponding to the toner consumption with respect to each small region is obtained by the gray scale value obtaining portion 92, the weighting calculating portion 94, and the weighting coefficient table stored in the coefficient storing portion 93.

Here, it is thought that there are a plurality of methods for carrying out the correcting calculation of the input signal value in the small region by the weighting calculating portion 94. Each of the methods includes a correcting calculation in which the signal input value of each pixel is converted to correct using the pixel within the small region so that a developing property of the electrostatic latent image of the signal input value equals to that of an actual signal value affected by the surrounding pixels.

For example, when the small region is configured as shown in FIG. 6, there is a method in which a total number of the signal input values of all the pixels within the small regions is obtained, and the signal input values of the respective pixels of interest are corrected by using the total number, and by a predetermined fixed calculation. In this case, in FIG. 6, the total number of the signal input values of all the pixels within the small regions is as follows: 128+64=192. The signal input value of the pixel pix1: 128 is corrected by calculation using this value. In a case in which the toner is negatively charged, and the larger signal input value represents the higher concentration state, when the signal input value of a certain pixel has a certain value, the larger the signal input values of the surrounding pixels, the smaller the signal input value which a developing property of the electrostatic latent image of this pixel approaches. Therefore, in the correcting calculation of this case, the larger the total number of the input signal values in the small regions, the smaller the signal input value of each pixel to be corrected.

Further, when the small region is configured as shown in FIG. 7, there is a method in which a total number of the signal input values of all the pixels within the small regions is obtained, and the signal input values of the respective pixels are corrected by using the total number, and by a predetermined fixed calculation. This method is similar to the correcting calculation for obtaining the total number of the signal input values in FIG. 6.

In both configurations of FIGS. 6 and 7, when the correcting calculation is carried out in order to convert the signal input value of the target pixel into the count in terms of toner amount, the signal input value of the target pixel, and the signal input value of at least another pixel are used.

Moreover, the weighting calculating portion 94 multiplies the signal values of the respective pixels obtained by correcting as described above by the weighting coefficients for converting to a count in terms of toner amount corresponding to the signal values which are read from the weighting coefficient table stored in the coefficient storing portion 93. The weighting coefficients for converting to the count in terms of toner amount are stored in the weighting coefficient table as a value corresponding to each signal value, since the toner consumption is not proportional to the signal value of the pixel. A multiplied result here is inputted to the accumulating portion 95. When there is used a configuration in which the total number of the signal input values of the respective pixels is calculated with respect to each small region and thereby the signal input values are corrected, in FIGS. 6 and 7, information of a correcting value corresponding to the total number of the signal input values is involved in the weighting coefficients for converting to the count in terms of toner amount in the weighting coefficient table, and the weighting coefficient is read out therefrom. Accordingly, correction of the signal input value and conversion into the count in terms of toner amount may be carried out at the same time.

The correcting calculation of the signal input value in the weighting calculating portion 94, and the calculation of the count in terms of toner amount of each pixel by conversion to a count in terms of toner amount, as described above, correspond to processing in which the toner consumption calculating portion 63 stores in advance a relationship between the gray scale data of the pixels within the small region and the toner consumption of the target pixel, including a content of the correcting calculation of the signal input value, and based on the relationship the gray scale data of the target pixel is converted into the count in terms of toner amount.

The accumulating portion 95 accumulates the signal value which is multiplied by the weighting coefficient for conversion to the count in terms of toner amount by the weighting calculating portion 94, with respect to all the pixels of the inputted multiple-value image. The accumulated value represents the count in terms of toner amount of the whole output image.

The weighting coefficient in the weighting coefficient table stored in the coefficient storing portion 93 is predetermined depending on the signal input value. Table 1 shows one example of the weighting coefficient table in a case of the signal input value having 16 values of 0 to 15.

TABLE 1

| | Input signal value | Weighting coefficient |
|---|---|---|
| Area 1 | 0 to 4 | 0 |
| Area 2 | 5 to 8 | 1 |
| Area 3 | 9 to 12 | 3 |
| Area 4 | 13 to 15 | 4 |

In Table 1, the 16 signal input values having the various toner consumptions are divided into four areas (Area 1 to Area 4), and the weighting coefficient is defined for each area. When the weighting calculating portion 72 carries out the weighting, the weighting coefficients divided into four areas are selected corresponding to the respective signal input values taking a value of 0 to 15, and thereby the weighting is carried out. In Table 1, the weighting coefficient of the signal input value of 0 to 4 is "0", the weighting coefficient of the signal input value of 5 to 8 is "1", the weighting coefficient of the signal input value of 9 to 12 is "3", and the weighting coefficient of the signal input value of 13 to 15 is "4".

Figure 8:
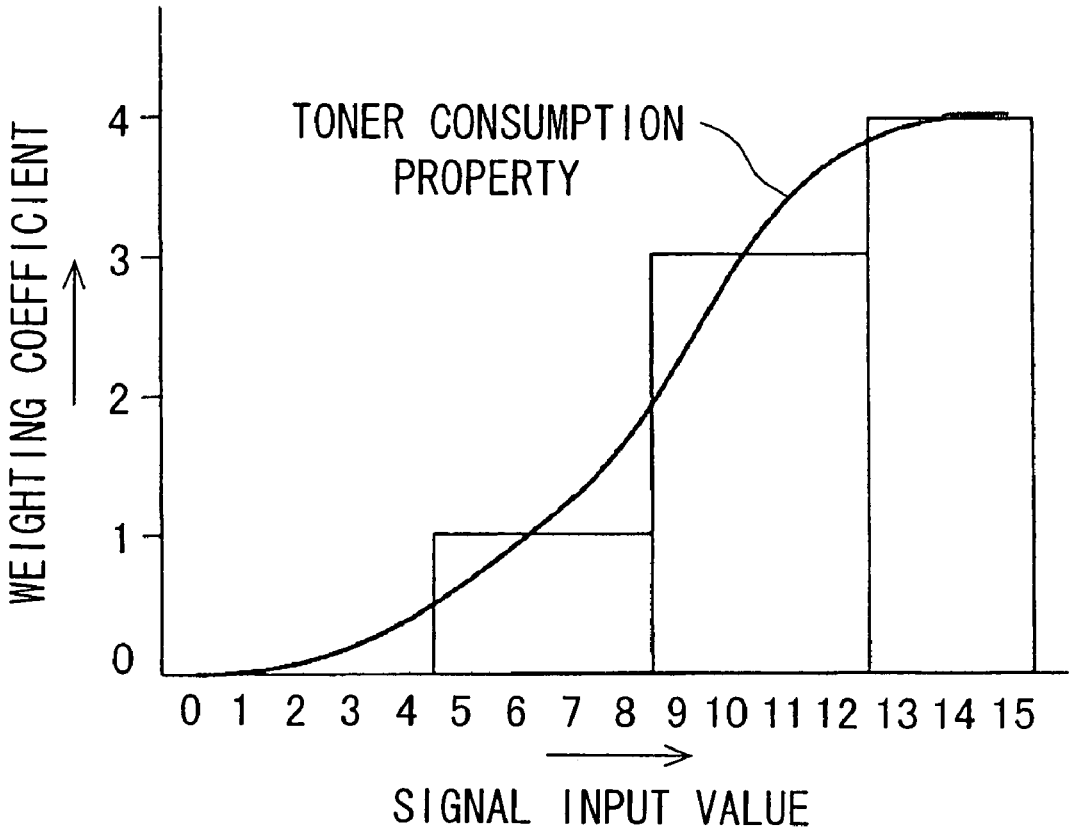
FIG. 8 is a view illustrating a relationship between a signal input value and a weighting coefficient corresponding to the signal input value, in a weighting coefficient table divided into four areas (four segmented regions) shown in Table 1.

FIG. 8 is a view illustrating a relationship between the signal input value and the weighting coefficient corresponding to the signal input value, in the weighting coefficient table divided into four areas (four segmented regions) shown in Table 1. In FIG. 8, a toner consumption property is shown with a solid curved line. As shown in FIG. 8, a total number of an area of a rectangular portion in each area substantially corresponds to an area of the curved line representing the toner consumption property. Therefore, an estimated value of the toner consumption can be calculated from the gray scale value after the weighting, that is, the accumulated value of the pixel count value.

Figure 9:
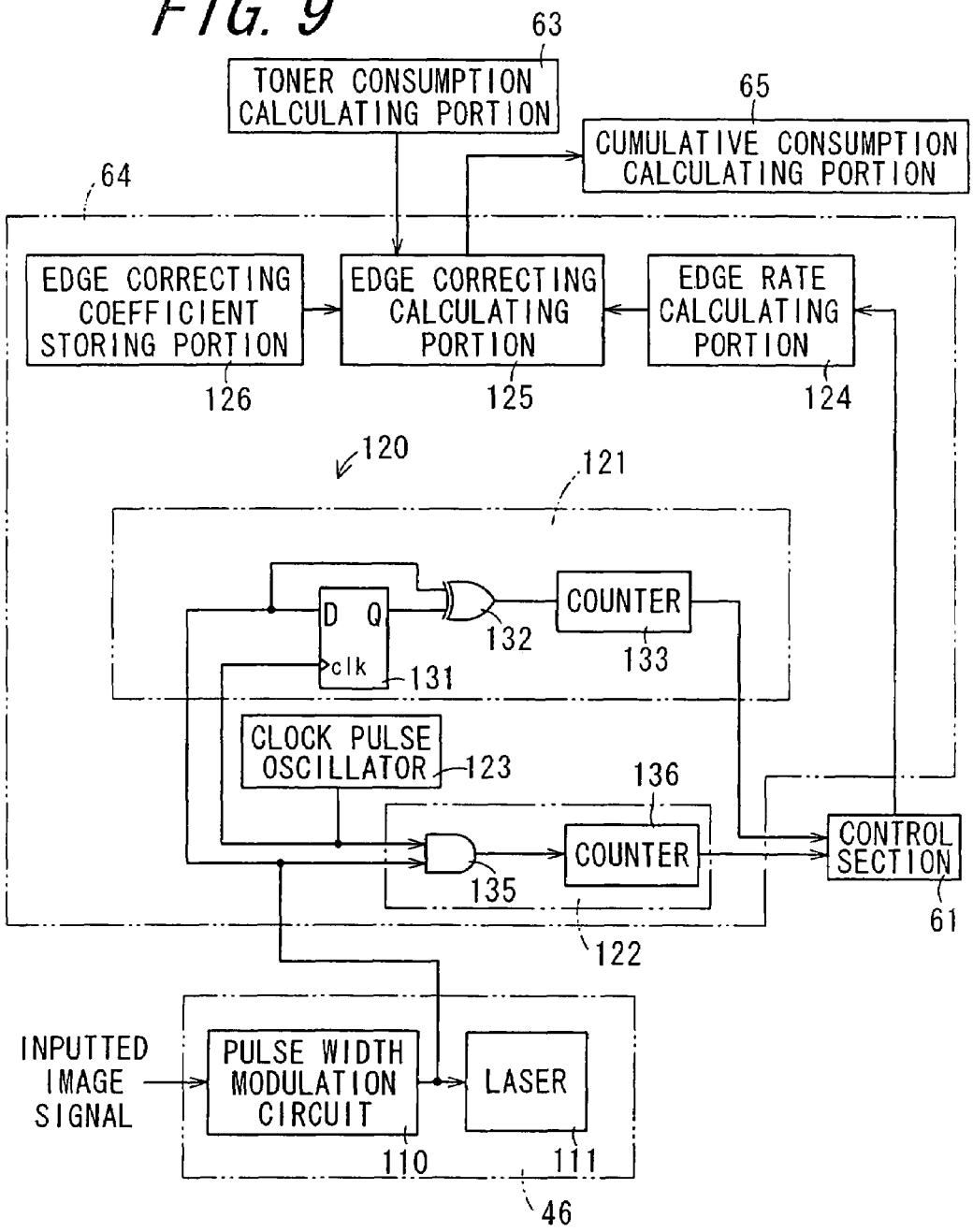
FIG. 9 is a block diagram illustrating a configuration of a corrected consumption calculating portion.

The corrected consumption calculating portion 64 corrects the toner consumption calculated by the toner consumption calculating portion 63 in view of the edge of the toner image. The "toner image" is a portion composed of the toner in an image formed by developing the electrostatic latent image, and, for example, a portion having the toner attached thereto in a recording sheet. FIG. 9 is a block diagram illustrating a configuration of the corrected consumption calculating portion 64. In FIG. 9, the controlling portion 61 of the toner replenishing device 11, the toner consumption calculating portion 63, the cumulative consumption calculating portion 65, and the laser writing unit 46 of the laser printer portion shown in FIG. 2 are collectively shown.

The corrected consumption calculating portion 64 includes an edge detecting portion 120, an edge rate calculating portion 124, an edge correction calculating portion 125, and an edge correcting coefficient storing portion 126. The edge detecting portion 120 includes an edge count portion 121, a dot count portion 122, and a clock pulse oscillator 123.

The edge count portion 121 includes a D flip-flop 131, an exclusive OR (abbreviated as an XOR) element (hereinafter, referred to as an "XOR gate") 132, and a counter 133. The edge count portion 121 counts a number of the edge of the toner image in the multiple-value image as the inputted image data. An output signal from the pulse width modulation circuit 110 in the laser writing unit 46 is supplied to one input terminal of the D flip-flop 131, and a clock pulse from the clock pulse oscillator 123 is supplied to the other input terminal thereof.

An output signal from an output terminal Q of the D flip-flop 131 is inputted to one input terminal of the XOR gate 132. The output signal from the pulse width modulation circuit 110 is supplied to the other input terminal of the XOR gate 132. Therefore, the XOR gate 132 compares the two output signals of two pixels adjacent to each other in a main scanning direction in the inputted multiple-value.

The XOR gate 132 carries out the exclusive OR of the output signal from the output terminal Q of the D flip-flop 131 and the output signal from the pulse width modulation circuit 110. That is, the XOR gate 132 outputs "0" when an input signal inputted from the D flip-flop 131 equals to an input signal supplied from the pulse width modulation circuit 110, and the XOR gate 132 outputs "1" when both are not equal. Pixels constituting the edge of the toner image have output signal values different from those of pixels adjacent to these pixels outside the toner image. Therefore, in a portion of the edge the input signal inputted from the D flip-flop 131 does not equal to the input signal supplied from the pulse width modulation circuit 110, and thereby "1" is outputted from the XOR gate 132.

The counter 133 accumulates every time the XOR gate 132 outputs "1" to calculate a number of the edge in the toner image. Accordingly, the number of the edge in the toner image can be obtained. The number of the edge in the toner image outputted from the counter 133 is inputted to the controlling portion 61.

The dot count portion 122 includes an AND element (hereinafter, referred to as an "AND gate") 135, and a counter 136. The dot count portion 122 counts a level of the output signal outputted from the pulse width modulation circuit 110 with respect to each pixel. The output signal from the pulse width modulation circuit 110 is supplied to one input terminal of the AND gate 135, and a clock pulse from the clock pulse oscillator 123 is supplied to the other input terminal thereof. Therefore, a number of the clock pulses corresponding to the pulse width of the laser driving pulse, that is, the number of the clock pulses corresponding to a concentration of each pixel is outputted.

The number of the clock pulses is accumulated by the counter 135 with respect to each pixel, and thereby a number of all pixels constituting the toner image is calculated. The number of all pixels of the toner image outputted from the counter 136 is inputted to the controlling portion 61.

The edge rate calculating portion 124 of the corrected consumption calculating portion 64 calculates a rate of the edge in the toner image, that is, a number of pixels in the edge based on all pixels constituting the toner image (the number of pixels in the edge/the number of all pixels), based on an output result from the edge count portion 121 and an output result from the dot count portion 122. Based on the edge rate, an edge correcting coefficient $\alpha$ stored in the edge correcting coefficient storing portion 126 is selected by the edge correcting calculating portion 125. The edge correcting calculating portion 125 multiplies a toner consumption w calculated by the toner consumption calculating portion 63 by the edge correcting coefficient $\alpha$ to calculate the corrected consumption of the toner.

The edge correcting coefficient stored in the edge correcting coefficient storing portion 126 is predetermined depending on the edge rate. Table 2 shows one example of the edge correcting coefficient $\alpha$ when there arises an edge effect in which a field strength in an edge portion is increased due to a spread of an electrical filed of an electrostatic latent image to increase an amount of a toner attached to the edge portion.

TABLE 2

| | Edge rate | Edge correcting coefficient α |
|---|---|---|
| Area 1 | 0% to less than 5% | 1.0 |
| Area 2 | 5% to less than 10% | 1.1 |
| Area 3 | 10% to less than 20% | 1.2 |
| Area 4 | 20% or more | 1.3 |

In Table 2, the edge rates are divided into four areas (Area 1 to Area 4), and the edge correcting coefficient α is defined for each area. When the toner corrected consumption is calculated by the edge collecting calculating portion 125, the edge correcting coefficients α determined for each area are selected corresponding to the respective edge rates. In Table 2, the edge correcting coefficient α is 1.0 when the edge rate is 0% to less than 5%, the edge correcting coefficient α is 1.1 when the edge rate is 5% to less than 10%, the edge correcting coefficient α is 1.2 when the edge rate is 10% to less than 20%, and the edge correcting coefficient α is 1.3 when the edge rate is 20% or more.

Table 3 shows one example of the edge correcting coefficient α when a repeatability of a thin line or a independent dot is decreased to decrease an amount of a toner attached to an edge portion.

TABLE 3

| | Edge rate | Edge correcting coefficient α |
|---|---|---|
| Area 1 | 0% to less than 5% | 1.0 |
| Area 2 | 5% to less than 10% | 0.9 |
| Area 3 | 10% to less than 20% | 0.8 |
| Area 4 | 20% or more | 0.7 |

In Table 3, likewise with respect to Table 2, the edge rates are divided into four areas (i.e., Area 1 to Area 4), and the edge correcting coefficient α is defined for each area. When the toner corrected consumption is calculated by the edge collecting calculating portion 125, the edge correcting coefficients α determined for each area are selected corresponding to the respective edge rates. In Table 3, the edge correcting coefficient α is 1.0 when the edge rate is 0% to less than 5%, the edge correcting coefficient α is 0.9 when the edge rate is 5% to less than 10%, the edge correcting coefficient α is 0.8 when the edge rate is 10% to less than 20%, and the edge correcting coefficient α is 0.7 when the edge rate is 20% or more.

In the copying machine 30 as an image forming apparatus, an influence of the edge effect is not uniform, and a level of the edge effect depends on an apparatus. In a case of an apparatus having the strong edge effect, in more detail, when the amount of the toner attached to the edge portion is larger than the amount of the toner attached to a portion other than the edge portion, the edge correcting coefficient α is defined so that the higher the edge rate, the larger the edge correcting coefficient α, and the edge correcting coefficients α shown in Table 2 are used, for example. In a case of an apparatus having the weak edge effect, in more detail, when the amount of the toner attached to the edge portion is smaller than the amount of the toner attached to a portion other than the edge portion due to an decrease in the repeatability of the thin line or the independent dot, or the like, the edge correcting coefficient α is defined so that the higher the edge rate, the smaller the edge correcting coefficient α, and the edge correcting coefficients α shown in Table 3 are used, for example. A level of the edge effect is obtained, for example, by a test in advance.

The cumulative consumption calculating portion 65 accumulates the corrected consumption as the toner consumption after correction inputted from the corrected consumption calculating portion 64 every time it is calculated. Therefore, when the value calculated by the cumulative consumption calculating portion 65 is accumulated and stored since a main replenishing operation by the main replenishing amount control portion 69 has been carried out, the cumulative toner consumption from a time when the main replenishing operation has been carried out is determined. Accordingly, the cumulative toner consumption can be precisely predicted and calculated. The cumulative toner consumption calculated is inputted to the main replenishing timing control portion 66. As described above, the cumulative consumption calculating portion 65 calculates the cumulative toner consumption from a time when a reference consumption Wref of a toner that is a first replenishing amount has been replenished into the developing tank 4 by the replenishing roller 8 as the replenishing section. The cumulative consumption calculating portion 65 corresponds to a cumulative-count-in-terms-of-toner-amount calculating portion.

The main replenishing timing control portion 66 is a delay circuit, delays the cumulative toner consumption inputted from the cumulative consumption calculating portion 65 by a predetermined time (hereinafter, referred to as a "delay time t1"), and outputs the cumulative toner consumption to the main replenishing amount control portion 69. The delay time t1 is set to a time since the toner consumption has been calculated based on the image data in the toner consumption calculating portion 63, until a developing process of the image corresponding to the image data which has been used for calculating the toner consumption is carried out between the developing roller 1 and the photoreceptor drum 48 and then the residual toner on the developing roller 1 after the developing process is recovered to the developing tank 4 and then moved to the vicinity of the replenishing roller 8 by the agitating rollers 2 and 3.

The main replenishing amount control portion 69 supplies a driving signal for driving the replenishing roller driving motor 71 to the replenishing roller main driving portion 70 when the cumulative toner consumption which has been inputted from the main replenishing timing control portion 66 is a predetermined value or more, and supplies a stopping signal for stopping the replenishing roller driving motor 71 to the replenishing roller main driving portion 70 when a signal which has been inputted from the main replenishing timing control portion 66 is less than the predetermined value. That is, the main replenishing amount control portion 69 allows the replenishing roller driving motor 71 to drive when the cumulative toner consumption which has been calculated by the cumulative consumption calculating portion 65 is larger than the reference value stored in the reference value memory portion 81*a* in the RAM 81, and allows the replenishing roller driving motor 71 to stop when the cumulative toner consumption which has been calculated by the cumulative consumption calculating portion 65 is smaller than the reference value stored in the reference value memory portion 81*a* in the RAM 81.

The main replenishing amount control portion 69 is configured, for example, with a monostable multivibrator for outputting a pulse having a constant time width, and is intermittently driven at a timing corresponding to a toner amount to be replenished. The main replenishing amount control portion 69 is not limited to the monostable multivibrator, and may have a configuration in which, for example, a rotating number of the replenishing roller driving motor 71 is controlled and thereby a toner replenishing amount is controlled. However, when the monostable multivibrator is used as the main replenishing amount control portion 69, the toner replenishing amount can be more precisely and stably controlled compared with a case in which the rotating number of the replenishing roller driving motor 71 is controlled.

The replenishing roller main driving portion 70 drives (intermittently drives) the replenishing roller driving motor 71 as a rotational driving source of the replenishing roller 8 while receiving a driving signal from the main replenishing amount control portion 69. Accordingly, the replenishing roller 8 is rotationally driven and thereby the toner in the toner replenishing tank 7 is replenished into the developing tank 4.

The toner concentration obtaining portion 73 obtains a toner concentration in the developing tank 4 based on an output signal from the toner concentration sensor 100, and outputs the obtained toner concentration to the auxiliary replenishing timing control portion 74.

The auxiliary replenishing timing control portion 74 as a delay circuit delays the toner concentration inputted from the toner concentration obtaining portion 73 by a delay time t2, and then inputs the toner concentration to the auxiliary replenishing amount control portion 75. The delay time t2 is set to a time since the toner concentration has been obtained in the toner concentration obtaining portion 73 until the two-component developer having the toner concentration measured is moved to a toner replenishing region by the toner replenishing device 11.

The auxiliary replenishing amount control portion 75 supplies the driving signal for driving the replenishing roller driving motor 71 or the stopping signal for stopping the same to the replenishing roller auxiliary driving portion 76 based on the signal which has been inputted from the auxiliary replenishing timing control portion 74. The auxiliary replenishing amount control portion 75 is configured, for example, with the monostable multivibrator for outputting a pulse having a constant time width, and is intermittently driven at a timing corresponding to a toner amount to be replenished. In addition, the auxiliary replenishing amount control portion 75 is not limited to the monostable multivibrator, and may have a configuration in which, for example, a rotating number of the replenishing roller driving motor 71 is controlled and thereby a toner replenishing amount is controlled. However, when the monostable multivibrator is used as the auxiliary replenishing amount control portion 75, the toner replenishing amount can be more precisely and stably controlled compared with a case in which the rotating number of the replenishing roller driving motor 71 is controlled.

The replenishing roller auxiliary driving portion 76 drives the replenishing roller driving motor 71 as a rotational driving source of the replenishing roller 8 while receiving a driving signal from the auxiliary replenishing amount control portion 75. Accordingly, the replenishing roller 8 is rotationally driven and thereby the toner in the toner replenishing tank 7 is replenished into the developing tank 4.

(Operation of Toner Replenishing Device 11)

Figure 10:
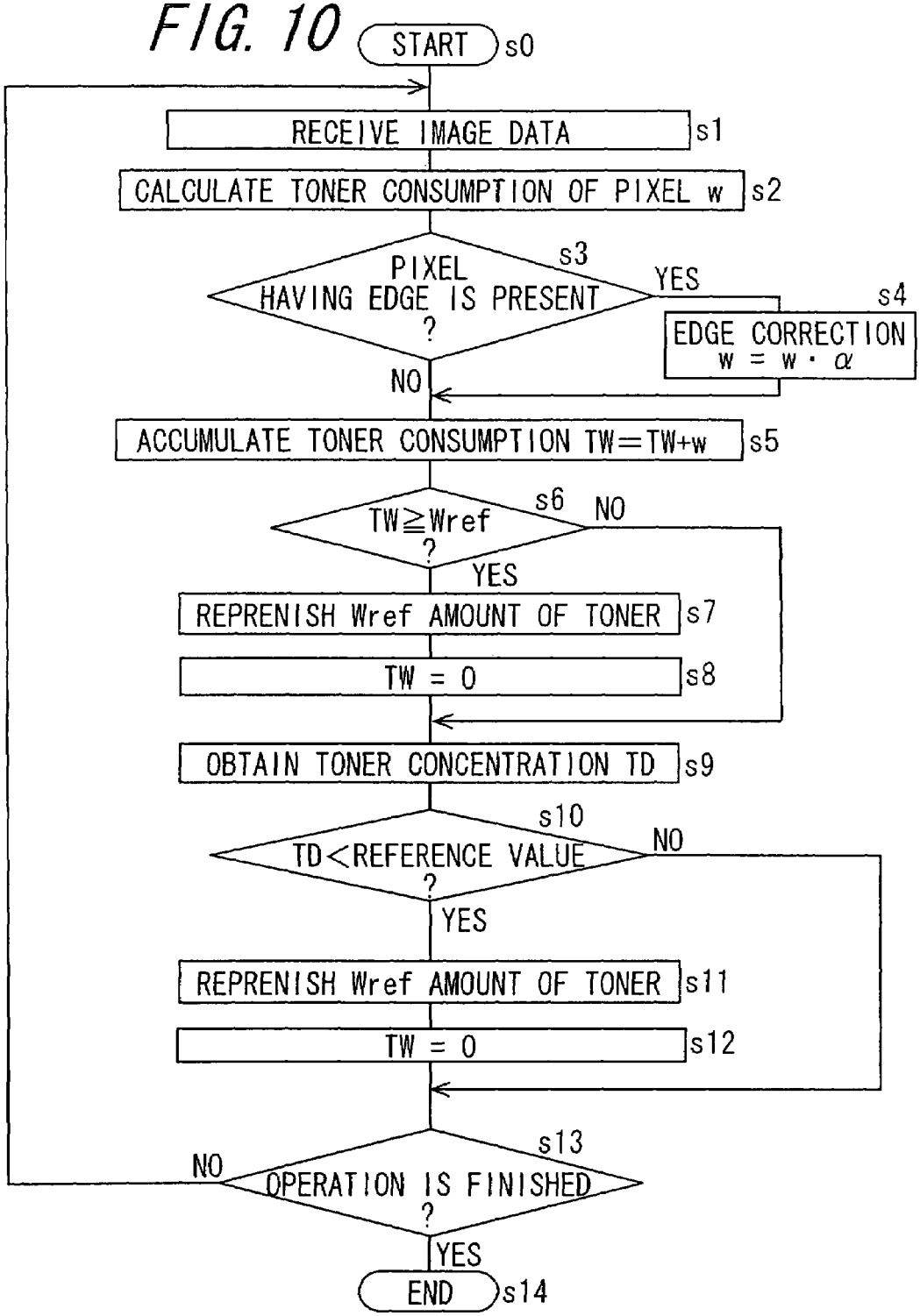
FIG. 10 is a flow chart illustrating a processing procedure with respect to a toner replenishing operation by the toner replenishing device.

An operation of the toner replenishing device 11 will be described. FIG. 10 is a flow chart illustrating a processing procedure with respect to a toner replenishing operation by the toner replenishing device 11. The toner replenishing operation by the toner replenishing device 11 is started when an image forming operation by the copying machine 30 is started, and the process proceeds to Step s1.

At Step s1, the image data input portion 62 accepts an input of an image data. The image data with respect to one page is inputted to the image data input portion 62. The inputted image data is inputted to the toner consumption calculating portion 63.

At Step s2, the toner consumption calculating portion 63 calculates the count in terms of toner amount corresponding to an estimated value of the toner consumption with respect to each pixel in the image data, accumulates the count in terms of toner amount with respect to all pixels, and calculates the toner consumption with respect to one page. In more detail, the toner consumption calculating portion 63 generates the small region from the inputted multiple-value image, carries out the correcting calculation, and then weights with respect to each pixel based on the weighting coefficient in the weighting coefficient table stored in the coefficient storing portion 93 shown in FIG. 5, to calculate the toner consumption w.

At Step 3, the control section 61 determines whether the inputted multiple-value image has the edge or not. When it is determined that the multiple-value image has the edge, the process proceeds to Step s4, and when it is determined that it does not have the edge, the process proceeds to Step s5.

At Step 4, the corrected consumption calculating portion 64 calculates the corrected toner consumption in view of the edge. In more detail, the corrected consumption calculating portion 64 calculates the edge rate in the toner image, that is, the number of the pixels in the edge based on all the pixels constituting the toner image (the number of the pixels in the edge/the number of all the pixels), based on the output result of the edge count portion 121 and the output result of the dot count portion 122. Based on the edge rate, the edge correcting coefficient $\alpha$ stored in the edge correcting coefficient storing portion 126 is selected by the edge correcting calculating portion 125. The edge correcting calculating portion 125 multiplies the toner consumption w calculated by the toner consumption calculating portion 63 by the edge correcting coefficient $\alpha$ to calculate the corrected consumption of the toner. When the corrected toner consumption is calculated in this manner, the process proceeds to Step s5.

At Step 5, the cumulative consumption calculating portion 65 accumulates the toner consumption w to calculate a cumulative toner consumption TW. When it is determined that the multiple-value image has the edge at Step s3, the corrected consumption is accumulated. The corrected consumption which has been calculated is outputted to the main replenishing amount control portion 69. In more detail, the control section 61 allows the main replenishing timing control portion 66 to delay the corrected consumption calculated by the corrected consumption calculating portion 64 by the predetermined time (the delay time t1), and to output the corrected consumption to the main replenishing amount control portion 69. When the cumulative toner consumption TW is calculated and outputted in this manner, the process proceeds to Step s6.

At Step s6, the main replenishing amount control portion 69 determines whether or not the calculated cumulative toner consumption TW is the predetermined reference consumption Wref or more. When it is determined that the cumulative toner consumption TW is the reference consumption Wref or more, the process proceeds to Step s7, and when it is determined that the cumulative toner consumption TW is less than the reference consumption Wref, the process proceeds to Step s9.

The reference consumption TW is selected in view of a difference between the corrected toner consumption calculated by the corrected consumption calculating portion 64 and the actual toner consumption. In more detail, the reference consumption Wref is selected to a value which is smaller than a value obtained by subtracting a maximum value of the difference between the corrected toner consumption calculated by the corrected consumption calculating portion 64 and the actual toner consumption from the corrected toner consumption calculated by the corrected consumption calculating portion 64. Accordingly, excessive replenishment of a toner can be prevented.

For example, when the maximum value of the difference between the corrected toner consumption calculated by the corrected consumption calculating portion 64 and the actual toner consumption is ±20%, the reference consumption Wref is selected to a value no more than 80% of the calculated corrected consumption. The reference consumption Wref may be set to a value less than 80% of the calculated corrected toner consumption (for example, 70%) in order to prevent excessive replenishment more certainly. Moreover, for example, when the maximum value of the difference between the corrected toner consumption calculated by the corrected consumption calculating portion 64 and the actual toner consumption is ±5%, the reference consumption Wref is selected to a value no more than 95% (for example, 90%) of the calculated corrected consumption.

At Step s7, the control section 61 controls so as to output a driving signal for driving the replenishing roller driving motor 71 from the main replenishing amount control portion 69 to the replenishing roller main driving portion 70, to drive the replenishing roller driving motor 71, and to replenish a toner having an amount corresponding to the reference consumption Wref to the developing tank 4. The amount corresponding to the reference consumption Wref corresponds to the first replenishing amount. The toner replenishing amount per rotation of the replenishing roller 8 is selected depending on the reference consumption Wref and a reference replenishing amount Wrs described later. For example, the toner replenishing amount per rotation of the replenishing roller 8 is selected to the reference consumption Wref.

When the toner is replenished in this manner, the process proceeds to Step s8. At Step s8, the accumulated value TW of the toner consumption in the cumulative consumption calculating portion 65 is reset to zero (0), and the process proceeds to Step s9.

At Step s9, the toner concentration obtaining portion 73 obtains the toner concentration TD from the output signal of the toner concentration sensor 100, outputs the toner concentration TD to the auxiliary replenishing amount control portion 75 through the auxiliary replenishing timing control portion 74, and the process proceeds to Step s10. In more detail, the control section 61 allows the auxiliary replenishing timing control portion 74 to delay the corrected consumption calculated by the corrected consumption calculating portion 64 by the predetermined time (the delay time t2), and to output the corrected consumption to the auxiliary replenishing amount control portion 75.

At Step s10, the auxiliary replenishing amount control portion 75 determines whether the inputted toner concentration TD is less than the predetermined start concentration or not. When it is determined that the toner concentration TD is less than the start concentration, the process proceeds to Step s11, and when it is determined that the toner concentration TD is the start concentration or more, the process proceeds to Step s13.

At Step s11, the control section 61 controls so as to output the driving signal for driving the replenishing roller driving motor 71 from the auxiliary replenishing amount control portion 75 to replenishing roller auxiliary driving portion 76, to drive the replenishing roller driving motor 71, and to replenish the toner having an amount corresponding to the reference replenishing amount Wrs to the developing tank 4. The reference replenishing amount Wrs corresponds to the second replenishing amount. The reference replenishing amount Wrs may have a value equal to the above-described reference consumption Wref, or may have a value different therefrom. After the toner is replenished in this manner, the process proceeds to Step s12. At Step s12, the counter TW of the toner consumption, that is, the accumulated value TW of the toner consumption is reset to zero (0), and the process proceeds to Step s13.

At Step s13, the control section 61 determines whether the image forming operation by the copying machine is completed, and completion of operation of the toner replenishing device 11 is instructed or not. When it is determined that the completion of operation is instructed, the process proceeds to Step s14, and is finished, and when it is determined that the completion of operation is not instructed, the process returns to Step s1, and a series of Steps starting from receiving of the image data are repeated.

In the embodiment, the cumulative toner consumption TW as the accumulated value of the toner consumption is reset to zero (0) at Step s12. Therefore, when it is determined that the cumulative toner consumption TW as the accumulated value of the toner consumption is less than the reference consumption Wref at Step s6, the reference consumption Wref of the toner is not replenished at Step s7, and it is determined that the toner concentration TD is less than the start concentration at Step S10, and thereby the reference replenishing amount Wrs of the toner is replenished, the cumulative consumption calculating portion 65 calculates the cumulative toner consumption TW from a time when the reference replenishing amount Wrs of the toner as the second replenishing amount has been replenished into the developing tank 4 by the replenishing roller 8, at Step s5 after the process has been returned from Step s13 to Step s1. As described above, the cumulative consumption calculating portion 65 calculates the cumulative toner consumption from a time the reference consumption Wref of the toner or the reference replenishing amount Wrs of the toner has been replenished into the developing tank 4 by the replenishing roller 8.

As described above, in the embodiment, a main replenishment as a toner replenishment based on the cumulative toner consumption calculated from the image data, and an auxiliary replenishment as a toner replenishment based on the toner concentration TD are carried out. The cumulative toner consumption which is used for comparing with the reference consumption in the main replenishment is calculated in view of the edge. Therefore, compared with a case in which the edge is not considered, a difference from the actual toner consumption can be further reduced, allowing more precise calculation of an estimated value of the toner consumption. In addition, in the auxiliary replenishment, when the toner concentration TD reaches less than the start concentration, the reference replenishing amount Wrs of the toner is replenished, allowing the toner concentration TD in the developing tank 4 to be kept to a concentration necessary for a developing operation.

As described above, in the embodiment, in addition to the main replenishment based on the calculated cumulative toner consumption, the auxiliary replenishment based on the toner concentration TD is carried out. Accordingly, a shortage of the toner replenishing amount based on the calculated cumulative toner consumption can be compensated so that the toner concentration TD in the developing tank 4 is brought close to a target value, allowing the stable toner concentration. Therefore, in the embodiment, excessive replenishment or insufficient replenishment of the toner to be consumed for a developing operation can be prevented, and thereby the toner concentration TD in the developing tank 4 can be kept constant.

Further, the auxiliary replenishment is carried out when the toner concentration TD is checked after the reference consumption Wref of the toner is replenished in the main replenishment, and the toner concentration is found to be less than the start concentration. As described above, in the main replenishment it is determined whether the auxiliary replenishment is carried out or not based on the cumulative toner consumption calculated in view of the edge. Therefore, a necessary amount of the toner can be replenished more appropriately when a replenishment is required. Accordingly, it becomes possible to quickly prevent the toner concentration TD from reaching less than the start concentration, thereby allowing reduction in a frequency of the auxiliary replenishment based on the toner concentration TD, and a control load by the control section 61.

Further, in the embodiment, the reference consumption Wref as an amount of the toner replenished in the main replenishment is selected so as to be smaller than a value obtained by subtracting a maximum value of a difference between the cumulative toner consumption TW and the actual toner consumption from the cumulative toner consumption TW calculated by the cumulative consumption calculating portion 65. Accordingly, when there arises a difference between the calculated cumulative toner consumption and the actual cumulative toner consumption, excessive replenishment of the toner due to the difference can be prevented.

Further, in the embodiment, the start concentration of the toner as a reference of whether the auxiliary replenishment is carried out or not is selected to a concentration in which a coverage of the toner to the carrier is 100% or less. Accordingly, a charge failure of the toner and occurrence of fogging can be prevented.

Further, in the embodiment, the toner replenishment based on the toner consumption calculated from the image data (the main replenishment) is carried out after the delay time t1 has elapsed since the cumulative toner consumption has been calculated in the cumulative consumption calculating portion 65. The delay time t1 is set to a time until a developing process of the image corresponding to the image data which has been used for calculating the toner consumption is carried out between the developing roller 1 and the photoreceptor drum 48 and then the residual toner on the developing roller 1 after the developing process is recovered to the developing tank 4 and then moved to the vicinity of the replenishing roller 8 by the agitating rollers 2 and 3.

As described above, by carrying out the main replenishment since the delay time t1 has elapsed, after the developing process of the image corresponding to the image data has been carried out, the toner replenishment corresponding to the toner consumption due to the developing process of the image can be carried out at an appropriate timing. Moreover, a necessary amount of the toner can be replenished to a region in which the toner concentration is decreased by the developing process, providing the more uniform toner concentration in the developing tank 4.

Further, in the embodiment, the toner replenishment based on the toner concentration TD (the auxiliary replenishment) is carried out after the delay time t2 has elapsed since the toner concentration TD has been obtained in the toner concentration obtaining portion 73. The delay time t2 is selected to a time until the toner having the toner concentration TD measured by the toner concentration sensor 100 is recovered into the developing tank 4, and transported to a toner replenishing region by the toner replenishing device 11.

By carrying out the auxiliary replenishment since the delay time t2 has elapsed, it can be prevented that a replenishing (a main replenishing) amount of the toner based on the cumulative toner consumption is added to a replenishing (an auxiliary replenishing) amount based on the toner concentration TD, and the resulting amount of the toner is replenished. Therefore, even when the replenishment based on a corrected consumption rate (the main replenishment) and the replenishment based on a detection result of the toner concentration (the auxiliary replenishment) are used in combination, excessive replenishment of the toner can be certainly prevented.

Further, in the embodiment, the replenishing roller main driving portion 70 and the replenishing roller auxiliary deriving portion 76 for driving the replenishing roller driving motor 71 are configured with the monostable multivibrator, and both driving portions intermittently drive the replenishing roller driving motor 71 depending on a replenishing amount of the toner. The replenishing amount is controlled by an intermittent driving in this manner, and thereby the replenishing amount can be stabilized, allowing the toner replenishment having a good control ability.

Further, in the embodiment, the toner consumption calculating portion 63 carries out a correcting calculation by grouping the inputted image data with respect to each small region by the small region generating portion 91, and then calculates an estimated value of the toner consumption of each pixel by using the weighting coefficient corresponding to the signal input values of the plurality of pixels included in the small region. Accordingly, the toner consumption can be calculated as a value considered for an effect of the signal input values of the surrounding pixels. Therefore, the toner consumption can be estimated and calculated more precisely. Therefore, excessive replenishment and insufficient replenishment can be prevented more certainly.

Further, in the embodiment, in the edge detecting portion 120, the edge count portion 121 detects the number of the pixels constituting the edge of the toner image with respect to a main scanning direction of the multiple-value image, and the dot count portion 122 detects a number of all the pixels constituting the edge of the toner image. When the number of the pixels constituting the edge with respect to the main scanning direction of the multiple-value image is counted in this manner, as shown in FIG. 9, a memory for one dot such as the D flip-flop 131 can be provided to count the number of the pixels constituting the edge. On the other hand, when trying to count the number of the pixels constituting the edge with respect to a vertical scanning direction perpendicular to the main scanning direction, one line of memory is required, resulting in a complicated configuration. As in the embodiment, the number of the pixels constituting the edge with respect to the main scanning direction is counted, thereby allowing a simple configuration in which the number of the pixels constituting the edge can be counted.

Further, the number of the pixels constituting the edge may be counted with respect to the vertical scanning direction in addition to the main scanning direction. However, as in the embodiment, the number of the pixels constituting the edge is counted only with respect to the main scanning direction, and the corrected consumption is calculated based on that count value. Accordingly, excessive replenishment of the toner can be certainly prevented.

In the embodiment described above, the edge detecting portion 120 uses the output signal from the pulse width modulation circuit 110 of the laser writing unit 46 to count the number of the pixels constituting the edge of the toner image and the number of all the pixels constituting the toner image. The edge detecting portion 120 is not limited to this configuration, and may be configured so as to count the number of the pixels constituting the edge of the toner image and the number of all the pixels constituting the toner image, using the image data inputted to the image data input portion 62. In this case, the edge count portion of the edge detecting portion is configured so that, for example, the image data to be inputted to the image data input portion 62 is binarized, and the gray scale values of the adjacent pixels are compared, and thereby a portion in which the gray scale value is changed from "0" to "1", or from "1" to "0" is counted as the edge. Further, the dot count portion is configured so as to count the number of the pixels constituting the toner image, for example, from the binarized image data.

Further, in the embodiment, the replenishing roller 8 is controlled by the control section 61 through the auxiliary replenishing amount control portion 75 so as to replenish the reference replenishing amount Wrs of the toner as a constant amount when the toner concentration TD obtained by the toner concentration obtaining portion 73 reaches less than the start concentration. A control method of the replenishing roller 8 is not limited to this method. For example, the replenishing roller 8 may be controlled by the control section 61 so that the toner replenishment to the developing tank 4 is started when the toner concentration TD obtained by the toner concentration obtaining portion 73 reaches less than the start concentration, and the toner replenishment to the developing tank 4 is stopped when the toner concentration TD obtained by the toner concentration obtaining portion 73 reaches at least a stop concentration which is higher than the start concentration.

The toner concentration of when stopping the toner replenishment is selected to a value larger than the toner concentration of when starting the toner replenishment, and the replenishing operation based on the toner concentration is adapted to have a hysteresis, thereby preventing a vibration called a chattering in the replenishing operation by the replenishing roller 8.

Figure 11:
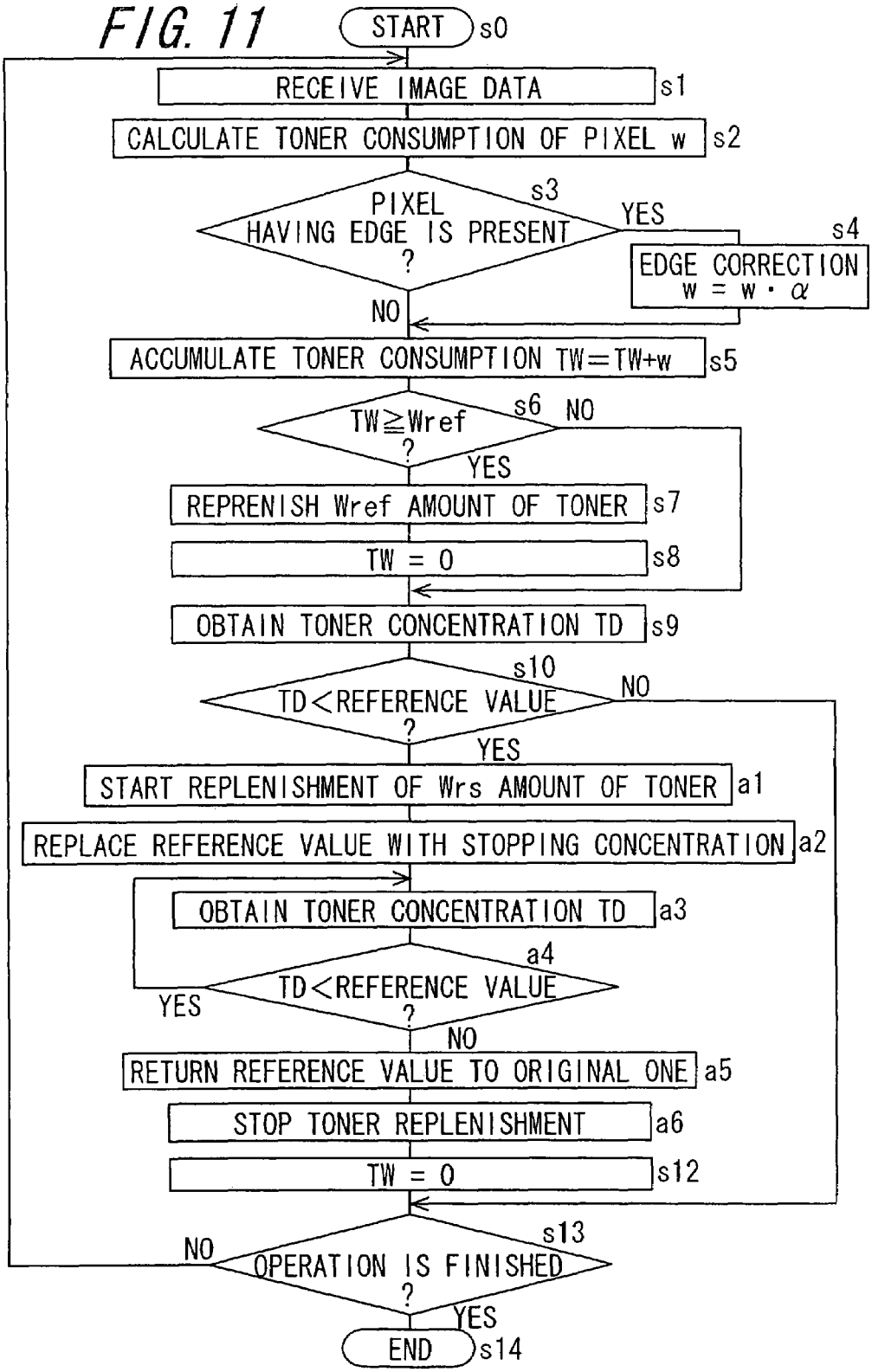
FIG. 11 is a flow chart illustrating another processing procedure with respect to the toner replenishing operation by the toner replenishing device.

When the hysteresis is applied in this manner, as shown in FIG. 11, Steps a1 to a6 are disposed in place of Step s11, after Step s10 and before Step s12 in the flow chart shown in FIG. 10 described above. In this case, when it is determined that the toner concentration TD is less than the start concentration as a reference value at Step s10, the process proceeds to Step a1. At Step a1, the reference replenishing amount Wrs of the toner is started to be replenished, and the process proceeds to Step a3.

At Step a2, the reference value of the toner concentration TD is replaced to the stop concentration larger than the start concentration as the original reference value. When the reference value is replaced from the start concentration to the stop concentration in this manner, the process proceeds to Step a3.

At Step a3, the toner concentration TD is obtained as in a case of Step s9, and the process proceeds to Step a4. At Step a4, it is determined whether the toner concentration TD is less than the stop concentration as the replaced reference value or not. At Step a4, when it is determined that the toner concentration TD is less than the stop concentration as the reference value, the process returns to Step a3 and the toner concentration TD is obtained once again. At this time, the replenishing roller driving motor 71 is continued to drive, and rotation of the replenishing roller 8 is continued. Therefore, the toner replenishment is continued, and the reference replenishing amount Wrs of the toner is replenished once again.

At Step a4, when it is determined that the toner concentration TD is not less than the stop concentration, that is, the toner concentration TD is the stop concentration or more, the process proceeds to Step a5. At Step a5, the reference value of the toner concentration is returned to the start concentration as the original reference value, and the process proceeds to Step a6. At Step a6, the replenishing roller driving motor 71 is stopped to drive, and thereby rotation of the replenishing roller 8 is stopped, and the toner replenishment is stopped, and the process proceeds to Step s12.

The start concentration is selected, for example, to 4.5%, and the stop concentration is selected, for example, to 4.8%. In the embodiment, the stop concentration is, not exclusively, selected to a value 5% to 20% larger than the start concentration.

The start concentration is selected to a value larger than a lower limit concentration which is a toner concentration minimum required for developing in the developing device 10. In the embodiment, the start concentration is, not exclusively, selected to a value 10% to 30% larger than the lower limit concentration.

The stop concentration is selected to a value smaller than an upper limit concentration which is an upper limit toner concentration required for carrying out a developing operation without trouble in the developing device 10. In the embodiment, the stop concentration is, not exclusively, selected to a value 10% to 30% smaller than the upper limit concentration.

Further, a configuration of the developing device 10 is not limited to a configuration including the developing roller 1, and the agitating rollers 2 and 3 as described in the embodiment. For example, a shape or an arrangement of the developing roller 1 and the agitating rollers 2 and 3, a number of the agitating roller, a shape of the developing tank 4 may be changed. When the configuration of the developing device 10 is different from the above-described configuration, the delay time t1 in the main replenishment may be set to a time until the residual toner on the developing roller (the developer bearing member) 1 after the developing process of the image corresponding to the image data used for calculating the cumulative toner consumption which has been calculated in the cumulative consumption calculating portion 65 is transported to a toner replenishing position through a predetermined path. In addition, the delay time t2 in the auxiliary replenishment may be set to a time until the toner having the toner concentration TD measured is transported to the toner replenishing position through the predetermined path.

Further, in the embodiment, the toner replenishing device 11 is, not exclusively, configured so as to replenish the toner to the toner replenishing tank 7. The toner replenishing device 11 may be configured so that the carrier is replenished in combination with the toner.

Further, in the embodiment, all processing in the toner concentration control system 60 is carried out by control of the control section 61. However, with no limitation to this method, a program for executing these processing may be stored in a recording medium, and an information processing device capable of reading out the program may be used in place of the control section 61.

In the above-described configuration, a calculating device (a CPU or an MPU) of the information processing device reads out the program stored in the recording medium and executes processing. Therefore, it can be described that the program itself achieves the processing.

Here, as the above-described information processing device, a function expansion board or a function expansion unit which is attached to a computer may be used other than typical computers (a work station or a personal computer)

Further, the above-described program means a program code (an executable format program, an intermediate code program, a source program, or the like) of software for achieving the processing. The program may be used alone or in combination with other programs (OS or the like). Moreover, the program may be a program which is read out from the recording medium, and is once stored in a memory (RAM or the like) in the device, and is then read out once again to be executed.

Further, the recording medium having the program stored therein may be easily separated from the information processing device, or may be fixed (attached) to the device. Furthermore, it may be connected with the device as an external recording device.

As the recording medium as described above, there can be applied magnetic tapes such as a video tape, and a cassette tape; magnetic disks such as a floppy (a registered trademark) disk, and a hard disk; optical disks (optical magnetic disks) such as a CD-ROM, a MO, a MD, a DVD, and a CD-R; memory cards such as an IC card and an optical card; and semiconductor memories such as a mask ROM, an EPROM, an EEPROM, and a Flush ROM.

Further, the recording medium connected with the information processing device through a network (an intranet, the internet, or the like) may be used. In this case, the information processing device obtains the program by downloading it through the network. That is, the above-described program may be obtained through a transmission medium (a medium for holding a program in a flowing state) such as the network (which is connected with a wired line or a wireless line). Note that a program used for downloading is preferably stored in the device (or a transmitting side device or a receiving side device) in advance.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and a range of equivalency of the claims are therefore intended to be embraced therein.

What is claimed is:

1. A toner replenishing device for replenishing a toner to a developer storing container for storing a two-component developer composed of a toner and a carrier which is disposed in a developing section where a toner image is formed by developing an electrostatic latent image formed on an image bearing member based on a multiple-value image composed of a plurality of pixels which are each represented by a gray scale value, comprising:

(a) a replenishing section capable of replenishing predetermined first and second replenishing amounts of the toner to the developer storing container;

(b) a toner consumption calculating unit for calculating a toner consumption in association with development of an electrostatic latent image corresponding to an inputted multiple-value image, based on the inputted multiple-value image, including:

(b1) a gray scale value obtaining portion for obtaining gray scale values of pixels of the inputted multiple-value image;

(b2) an edge detecting portion for detecting an edge in the multiple-value image; and (b3) a calculating portion for obtaining an estimated value of a toner consumption from the gray scale value obtained by the gray scale value obtaining portion, and a detection result of edge by the edge detecting portion, and calculating a cumulative toner consumption from a time when the first replenishing amount of the toner has been replenished to the developer storing container, with the use of the estimated value;

(c) a concentration obtaining portion for obtaining a toner concentration of the two-component developer stored in the developer storing container; and (d) a control section for controlling the replenishing section so that when the cumulative toner consumption calculated by the toner consumption calculating unit reaches at least a predetermined reference consumption, the first replenishing amount of the toner is replenished to the developer storing container, and when the toner concentration obtained by the concentration obtaining portion falls below a predetermined start concentration, the second replenishing amount of the toner is started to be replenished to the developer storing container.

2. The toner replenishing device of claim 1, wherein the edge detecting portion detects a number of the pixels constituting the edge of the toner image with respect to a main scanning direction of the multiple-value image, and detects a total number of the pixels constituting the toner image, and the calculating portion calculates the estimated value of the toner consumption by using the gray scale value obtained by the gray scale value obtaining portion, and a rate of the number of the pixels constituting the edge detected by the edge detecting portion to the total number of the pixels constituting the toner image.

3. The toner replenishing device of claim 1, wherein the calculating portion includes:

a small region generating portion for generating a small region composed of the plurality of pixels from the multiple-value image so that the respective pixels of the multiple-value image are included in any one of the small regions as a target pixel which is subjected to a process for conversion to a count in terms of toner amount, in order to convert respective numbers of pixels of the multiple-value image into count values having correlation with the toner consumptions;

a count-in-terms-of-toner-amount calculating portion for converting the gray scale value of the target pixel within the small region generated by the small region generating portion, into a count in terms of toner amount, using the gray scale value of the target pixel and a gray scale value of at least one another pixel within the small region including the target pixel, based on a previously-stored relationship between the gray scale value of the pixel within the small region and the toner consumption of the target pixel, and calculates the count in terms of toner amount of all the pixels of the multiple-value image from the respective counts in terms of toner amount of the target pixels which have been converted; and a cumulative-count-in-terms-of-toner-amount calculating portion for accumulating the count in terms of toner amount of all the pixels which has been calculated by the count-in-terms-of-toner-amount calculating portion, every time the count in terms of toner amount of the multiple-value image is calculated, to calculate the cumulative count in terms of toner amount.

4. The toner replenishing device of claim 1, wherein the control section controls the replenishing section so as to start to replenish the toner after a predetermined delay time has elapsed since the cumulative toner consumption has been calculated by the calculating portion.

5. The toner replenishing device of claim 1, wherein the control section controls the replenishing section so as to start to replenish the toner after a predetermined delay time has elapsed since the toner consumption has been obtained by the toner concentration obtaining portion.

6. The toner replenishing device of claim 1, wherein the start concentration is a concentration in which a coverage of the toner to the carrier reaches 100% or less.

7. The toner replenishing device of claim 1, wherein the control section controls the replenishing section so that when the toner concentration obtained by the concentration obtaining portion reaches less than the start concentration, replenishment of the toner to the developer storing container is started, and when the toner concentration reaches at least a stop concentration in which the toner concentration is larger than the start concentration, the replenishment of the toner to the developer storing container is stopped.

8. An image forming apparatus comprising:

a latent image forming section for forming an electrostatic latent image on an image bearing member based on a multiple-value image which is composed of a plurality of pixels, and in which each pixel is represented by a gray scale value;

a developing section which includes a developer storing container for storing a two-component developer composed of a toner and a carrier, for developing the electrostatic latent image formed on the image bearing member using the two-component developer to form a toner image; and the toner replenishing device of claim 1 for replenishing the toner to the developer storing container in the developing section.

* * * * *